US008983358B2

(12) United States Patent
Ota

(10) Patent No.: US 8,983,358 B2
(45) Date of Patent: Mar. 17, 2015

(54) DEVELOPER STORAGE BODY, DEVELOPER COLLECTING APPARATUS AND IMAGE FORMING APPARATUS

(71) Applicant: Atsushi Ota, Tokyo (JP)

(72) Inventor: Atsushi Ota, Tokyo (JP)

(73) Assignee: Oki Data Corporation, Tokyo (JP)

( * ) Notice: Subject to any disclaimer, the term of this patent is extended or adjusted under 35 U.S.C. 154(b) by 35 days.

(21) Appl. No.: 13/847,029

(22) Filed: Mar. 19, 2013

(65) Prior Publication Data

US 2013/0259495 A1 Oct. 3, 2013

(30) Foreign Application Priority Data

Mar. 28, 2012 (JP) ..... 2012-074492

(51) Int. Cl.
*G03G 21/12* (2006.01)
*G03G 21/10* (2006.01)
*G03G 15/08* (2006.01)

(52) U.S. Cl.
CPC ..... *G03G 21/12* (2013.01); *G03G 21/105* (2013.01); *G03G 15/0856* (2013.01)
USPC ..... 399/360

(58) Field of Classification Search
CPC ..... G03G 21/10; G03G 21/12
USPC ..... 399/358, 360
See application file for complete search history.

(56) References Cited

U.S. PATENT DOCUMENTS

| | | | | |
|---|---|---|---|---|
| 8,380,117 | B2 * | 2/2013 | Ohta | 399/360 |
| 8,611,770 | B2 * | 12/2013 | Mizutani et al. | 399/35 |
| 2006/0039710 | A1 * | 2/2006 | Tawada | 399/35 |

FOREIGN PATENT DOCUMENTS

| | | | |
|---|---|---|---|
| JP | H11-84850 | A | 3/1999 |
| JP | 2002-072657 | A | 3/2002 |
| JP | 2008-083630 | A | 4/2008 |
| JP | 2010-266897 | A | 11/2010 |
| JP | 2011-095518 | A | 5/2011 |
| JP | 2012-032621 | A | 2/2012 |

* cited by examiner

*Primary Examiner* — Gregory H Curran
(74) *Attorney, Agent, or Firm* — Panitch Schwarze Belisar & Nadel LLP

(57) ABSTRACT

A developer storage body includes a developer storage portion configured to store a developer. The developer storage portion has a first end portion and a second end portion opposite to each other. A developer ejecting portion is provided in the developer storage portion is located closer to the first end portion than to the second end portion. The developer ejecting portion is configured to eject the developer into the developer storage portion. The developer storage body further includes a developer pushing portion configured to push the developer ejected into the developer storage portion from the developer ejecting portion toward the second end portion. A developer detecting portion is provided in the developer storage portion and is located closer to the second end portion than to the first end portion.

12 Claims, 18 Drawing Sheets

DEVELOPER STORAGE BODY, DEVELOPER COLLECTING APPARATUS AND IMAGE FORMING APPARATUS

BACKGROUND OF THE INVENTION

The present invention relates to a developer storage body used in an electrophotographic process, and also relates to a developer collecting apparatus and an image forming apparatus having the developer storage body.

An electrophotographic image forming apparatus includes a developer storage body for storing a developer (for example, a waste developer). The developer storage body is elongated, and a receiving opening is provided at an end portion of the developer storage body in a longitudinal direction. A detection member is provided in the vicinity of the receiving opening for detecting that the developer storage body is filled with the developer (see, for example, Japanese Laid-open Patent Publication No. 2011-95518).

In this regard, there are cases where a sufficient amount of the developer is not stored in the developer storage body. Therefore, there is a demand for increasing an amount of the developer stored in the developer storage body.

SUMMARY OF THE INVENTION

An aspect of the present invention is intended to increase an amount of a developer stored in a developer storage body.

According to an aspect of the present invention, there is provided a developer storage body including a developer storage portion configured to store a developer and having a first end portion and a second end portion opposite to each other, and a developer ejecting portion provided in the developer storage portion and located closer to the first end portion than to the second end portion. The developer ejecting portion is configured to eject the developer into the developer storage portion. The developer storage body further includes a developer pushing portion configured to push the developer ejected into the developer storage portion from the developer ejecting portion toward the second end portion. The developer storage body further includes a developer detecting portion provided in the developer storage portion and located closer to the second end portion than to the first end portion.

With such a configuration, it becomes possible to increase an amount of the developer in the developer storage container.

According to another aspect of the present invention, there is provided a developer collecting apparatus including a developer storage portion configured to store a developer and having a first end portion and a second end portion opposite to each other, a developer ejecting portion provided in the developer storage portion and located closer to the first end portion than to the second end portion, a developer pushing portion configured to push the developer supplied into the developer storage portion from the developer ejecting portion toward the second end portion, and a developer detecting portion provided in the developer storage portion and located closer to the second end portion than to the first end portion.

According to yet another aspect of the present invention, there is provided an image forming apparatus including the above described develop storage body.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings. The drawings are provided for illustrative purpose and are not intended to limit the scope of the present invention.

First Embodiment

Figure 1:
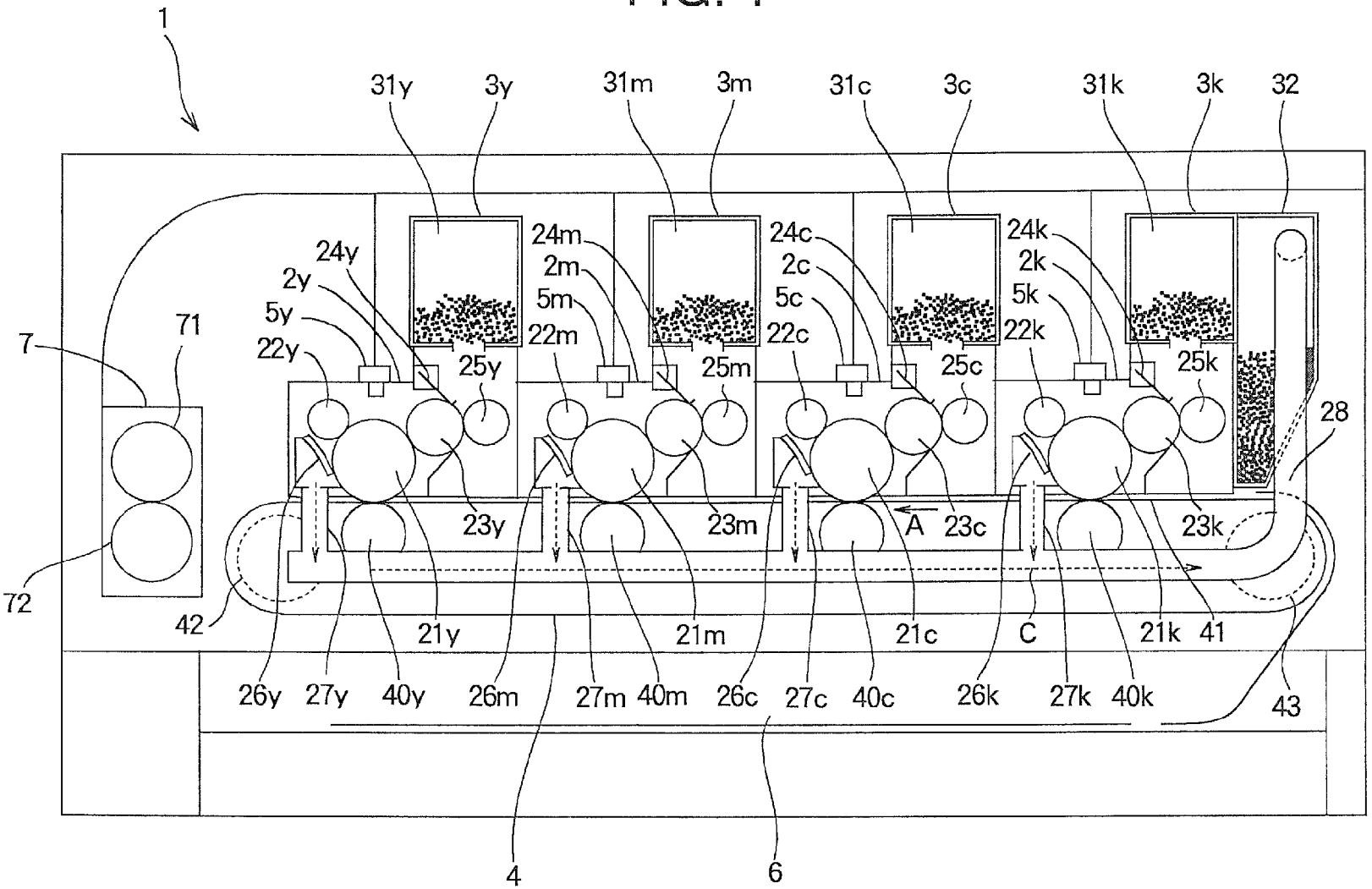
FIG. 1 is a schematic sectional view showing a configuration of an electrophotographic printer as an image forming apparatus according to the first embodiment of the present invention.

Hereinafter, the first embodiment of the present invention will be described. FIG. 1 is a schematic sectional view showing an electrophotographic printer 1 as an image forming apparatus according to the first embodiment of the present invention.

As shown in FIG. 1, the electrophotographic printer (hereinafter, referred to as a printer) 1 includes a medium feeding unit 6 configured to store media (such as printing sheets) and to feed the media. The printer 1 further includes developing units (i.e., process units) 2*k*, 2*c*, 2*m* and 2*y* which are arranged along a feeding path of the medium fed by the medium feeding unit 6. LED heads (i.e., exposure units) 5*k*, 5*c*, 5*m* and 5*y* are provided on one side (for example, an upper side) of the developing units 2*k*, 2*c*, 2*m* and 2*y* so as to face the developing units 2*k*, 2*c*, 2*m* and 2*y*. A transfer unit 4 is provided on the other side (for example, a lower side) of the developing units 2*k*, 2*c*, 2*m* and 2*y* so as to face the developing units 2*k*, 2*c*, 2*m* and 2*y*. A fixing unit 7 is provided downstream of the developing units 2*k*, 2*c*, 2*m* and 2*y* in a feeding direction of the medium.

The medium feeding unit 6 includes a medium cassette in which a stack of the media is stored, and a medium feeding mechanism that feeds the media one by one from the medium cassette. The medium feeding mechanism includes, for example, a pickup roller, a feed roller, a registration roller and the like, but detailed descriptions thereof will be omitted. The medium fed from the medium feeding unit 6 proceeds in a direction shown by an arrow A (for example, from the right to the left in FIG. 1) along the feeding path provided in the printer 1.

The developing units 2*k*, 2*c*, 2*m* and 2*y* are configured to form toner images (i.e., developer images) of black, cyan, magenta and yellow. The developing units 2*k*, 2*c*, 2*m* and 2*y* are arranged on a line along the feeding path of the medium (for example, from the right to the left in FIG. 1).

The LED (Light Emitting Diode) heads 5*k*, 5*c*, 5*m* and 5*y* are configured to emit light to thereby expose surfaces of respective photosensitive drums (described later) of the developing units 2*k*, 2*c*, 2*m* and 2*y* to form latent images. The LED heads 5*k*, 5*c*, 5*m* and 5*y* are mounted to, for example, a top cover of the printer 1.

The developing units 2*k*, 2*c*, 2*m* and 2*y* include photosensitive drums 21*k*, 21*c*, 21*m* and 21*y* as image bearing bodies, charging rollers 22*k*, 22*c*, 22*m* and 22*y* as charging members, developing rollers 23*k*, 23*c*, 23*m* and 23*y* as developer bearing bodies, developing blades 24*k*, 24*c*, 24*m* and 24*y* as developer layer forming members, and supplying rollers 25*k*, 25*c*, 25*m* and 25*y* as supplying members.

The photosensitive drums 21*k*, 21*c*, 21*m* and 21*y* are configured to bear latent images on surfaces thereof. The charging rollers 22*k*, 22*c*, 22*m* and 22*y* are configured to uniformly charge surfaces of the photosensitive drums 21*k*, 21*c*, 21*m* and 21*y*. The developing rollers 23*k*, 23*c*, 23*m* and 23*y* are configured to develop latent images on the surfaces of the photosensitive drums 21*k*, 21*c*, 21*m* and 21*y* formed by the LED heads 5*k*, 5*c*, 5*m* and 5*y*. The developing blades 24*k*, 24*c*, 24*m*, and 24*y* are configured to form toner layers (i.e., developer layers) on the surfaces of the photosensitive drums 21*k*, 21*c*, 21*m* and 21*y*. The supplying rollers 25*k*, 25*c*, 25*m* and 25*y* are configured to supply the toner to the developing rollers 23*k*, 23*c*, 23*m* and 23*y*.

The developing units 2*k*, 2*c*, 2*m* and 2*y* further include cleaning blades 26*k*, 26*c*, 26*m* and 26*y* as cleaning members and first conveying mechanisms 27*k*, 27*c*, 27*m* and 27*y* as first conveying units. The cleaning blades 26*k*, 26*c*, 26*m* and 26*y* are configured to remove residual toner on the surfaces of the photosensitive drums 21*k*, 21*c*, 21*m* and 21*y* which has not been transferred to the medium. The first conveying mechanisms 27*k*, 27*c*, 27*m* and 27*y* are configured to convey the toner (i.e., a waste toner) removed by the cleaning blades 26*k*, 26*c*, 26*m* and 26*y*.

The first conveying mechanisms 27*k*, 27*c*, 27*m* and 27*y* have, for example, spirals in the form of coils. The first conveying mechanisms 27*k*, 27*c*, 27*m* and 27*y* receive the waste toner removed by the cleaning blades 26*k*, 26*c*, 26*m* and 26*y* from the surfaces of the photosensitive drums 21*k*, 21*c*, 21*m* and 21*y*, and convey the waste toner in an axial direction of the photosensitive drums 21*k*, 21*c*, 21*m* and 21*y*.

Toner cartridges 3*k*, 3*c*, 3*m* and 3*y* (i.e., developer cartridges) are detachably mounted to upper parts of the developing units 2*k*, 2*c*, 2*m* and 2*y*. The toner cartridges 3*k*, 3*c*, 3*m* and 3*y* are configured to store toner (i.e., developer) of respective colors. The toner cartridges 3*k*, 3*c*, 3*m* and 3*y* include toner storage portions (i.e., developer storage containers) 31*k*, 31*c*, 31*m* and 31*y* for storing unused (i.e., fresh) toner.

The transfer unit 4 includes a transfer belt 41, and includes a driving roller 42 and a driven roller 43 around which the transfer belt 41 is stretched. The transfer unit 4 further includes transfer rollers 40*k*, 40*c*, 40*m* and 40*y* (i.e., transfer members) provided so as to face photosensitive drums 21*k*, 21*c*, 21*m* and 21*y*.

The transfer belt 41 moves in a direction as shown by the arrow A by a rotation of the driving roller 42. The transfer belt 41 absorbs and holds the medium at a surface thereof, and feeds the medium in the direction shown by the arrow A. The driven roller 43 applies a predetermined tension to the transfer belt 41. The transfer rollers 40*k*, 40*c*, 40*m* and 40*y* are applied with predetermined transfer voltages, and transfer toner images from the surfaces of the photosensitive drums 21*k*, 21*c*, 21*m* and 21*y* to a surface of the medium held on the transfer belt 41.

The fixing unit 7 includes, for example, a fixing roller 71 having an internal heat source and a pressure roller 72 pressed against the fixing roller 71. The fixing roller 71 and the pressure roller 72 are configured to apply heat and pressure to the medium with the toner image transferred thereto, so as to fix the toner image to the medium. Although not shown in FIG. 1, an ejection mechanism is provided downstream of the fixing unit 7 for ejecting the medium with the fixed toner image.

Figure 2:
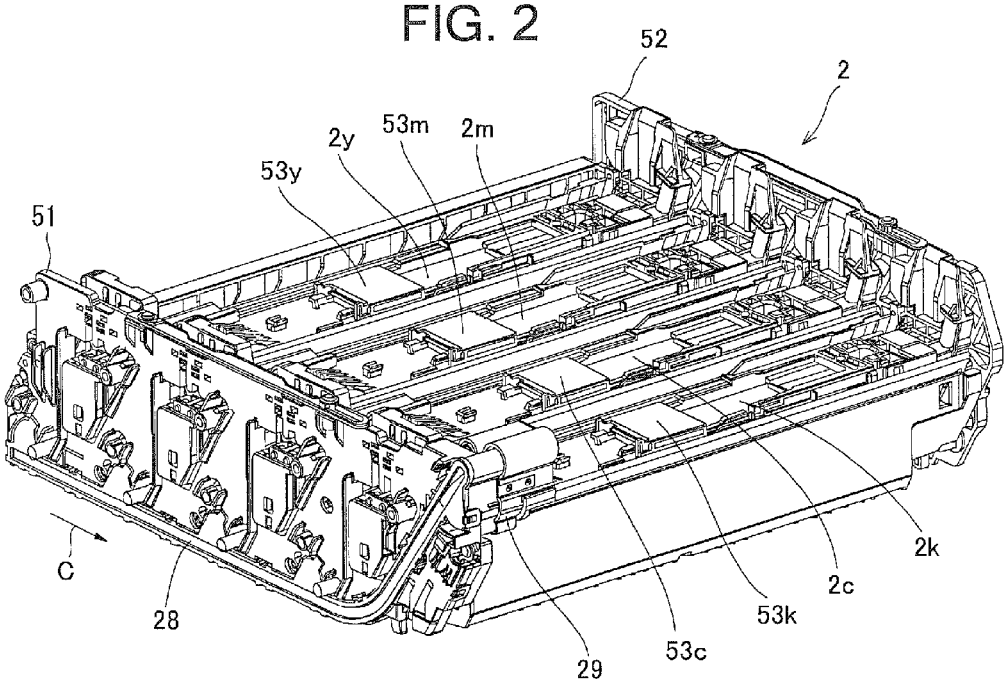
FIG. 2 is a perspective view showing a developing device in which developing units according to the first embodiment are integrated.
Figure 3:
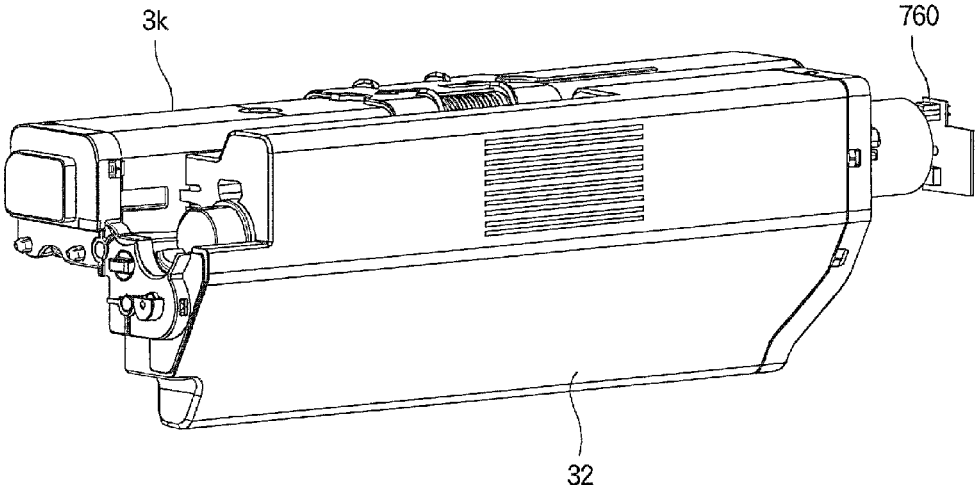
FIG. 3 is a perspective view showing a waste toner collecting container and a black toner cartridge according to the first embodiment.
Figure 4:
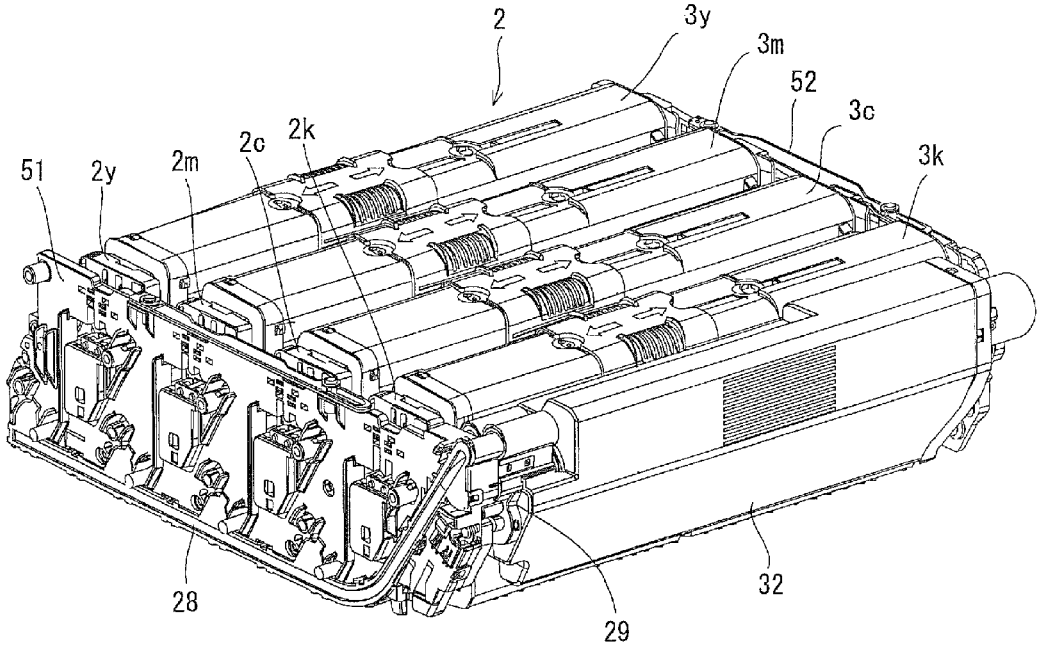
FIG. 4 is a perspective view showing the developing device to which the toner cartridges are mounted according to the first embodiment.

FIG. 2 is a perspective view showing a developing device (i.e., a process unit assembly) 2 in which the developing units 2*k*, 2*c*, 2*m* and 2*y* are integrated. FIG. 3 is a perspective view showing a waste toner collecting container 32 and the black toner cartridge 3*k*. FIG. 4 is a perspective view showing the developing device 2 with toner cartridges 3*k*, 3*c*, 3*m* and 3*y* mounted to developing units 2*k*, 2*c*, 2*m* and 2*y*.

As shown in FIG. 2, the developing units 2*k*, 2*c*, 2*m* and 2*y* are arranged at equal intervals in such a manner that longitudinal directions of the developing units 2*k*, 2*c*, 2*m* and 2*y* (i.e., axial directions of the photosensitive drums 21*k*, 21*c*, 21*m* and 21*y*) are parallel to each other. The developing units 2*k*, 2*c*, 2*m* and 2*y* are integrally held by a first side frame 51 and a second side frame 52 both of which have high rigidity. The first side frame 51 and the second side frame 52 are provided on both sides of the developing units 2*k*, 2*c*, 2*m* and 2*y* in the longitudinal direction thereof.

The first side frame 51 includes a second conveying mechanism 28 as a second conveying unit. The second conveying mechanism 28 is connected to the first conveying mechanisms 27*k*, 27*c*, 27*m* and 27*y* (FIG. 1) of the developing units 2*k*, 2*c*, 2*m* and 2*y*. The second conveying mechanism 28 is configured to receive the waste toner from the first conveying mechanisms 27*k*, 27*c*, 27*m* and 27*y*, and to convey the waste toner in a direction shown by an arrow C.

A waste toner collecting container 32 (FIGS. 3 and 4) as a developer collecting apparatus (i.e., a developer storage body) is provided upstream of the developing units 2*k*, 2*c*, 2*m* and 2*y* in an arranging direction of the developing units 2*k*, 2*c*, 2*m* and 2*y*. In other words, the waste toner collecting container 32 is disposed adjacent to the black developing unit 2*k*. The first side frame 51 includes a waste toner ejecting portion 29 (FIG. 2) as a developer ejecting portion. The waste toner ejecting portion 29 is formed to connect the second conveying mechanism 28 and a waste toner receiving opening 720 (FIG. 5) of the waste toner collecting container 32.

As shown in FIG. 3, the waste toner collecting container 32 is mounted to the black toner cartridge 3*k*. Generally, black toner is used more frequently than other colors, and therefore the black toner cartridge 3*k* is most frequently replaced. For this reason, the waste toner collecting container 32 is mounted to the black toner cartridge 3*k* so that the waste toner collecting container 32 is replaced at an early stage before the waste toner collecting container 32 is filled with the waste toner.

However, the present invention is not limited to such a configuration. For example, the waste toner collecting container 32 can be mounted to any of the toner cartridges 3*c*, 3*m* and 3*y* other than black toner cartridge 3*k*. Further, the waste toner collecting container 32 can be configured separately from the toner cartridges 3*k*, 3*c*, 3*m* and 3*y*. In other words, the waste toner collecting container 32 can be mounted to and detached from the developing device 2 separately (independently) from the toner cartridges 3*k*, 3*c*, 3*m* and 3*y*.

In a state where the toner cartridges 3*k*, 3*c*, 3*m* and 3*y* are mounted to the developing device 2 as shown in FIG. 4, the waste toner ejecting portion 29 of the first side frame 51 is connected to the waste toner receiving opening 720 (FIG. 5) of the waste toner collecting container 32 mounted to the black toner cartridge 3*k*.

The developing device 2 and the toner cartridges 3*k*, 3*c*, 3*m* and 3*y* are replaceable units, and can be replaced when the toner is consumed or when a lifetime of any component expires.

Referring back to FIG. 2, toner receiving openings are formed on upper parts of the developing units 2*k*, 2*c*, 2*m* and 2*y*. The toner receiving openings are provided for receiving the toner from the toner cartridges 3*k*, 3*c*, 3*m* and 3*y*. The toner receiving openings are opened and closed by shutter members 53*k*, 53*c*, 53*m* and 53*y*.

Figure 5:
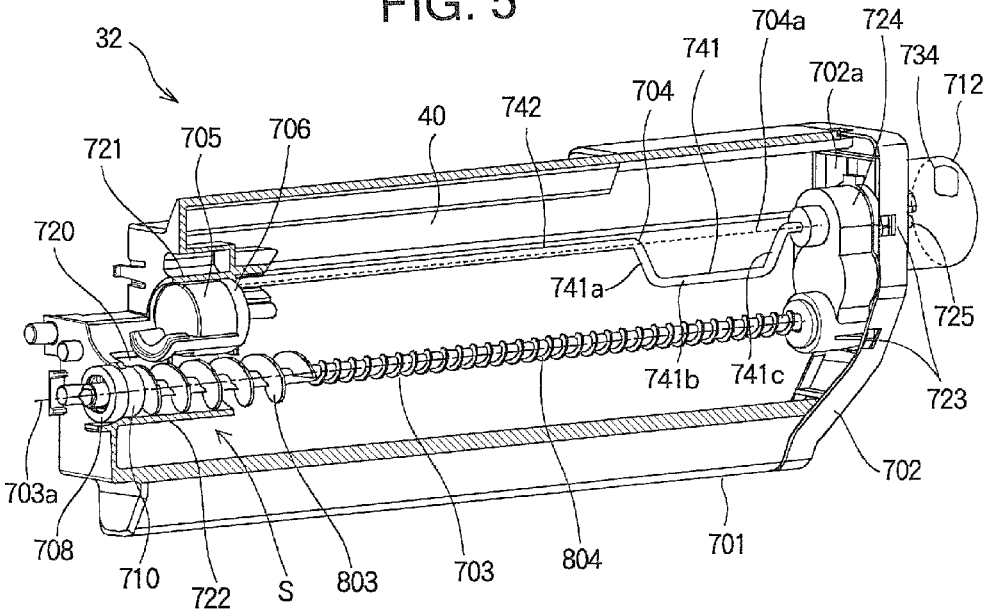
FIG. 5 is a partially cut-away perspective view showing the waste toner collecting container according to the first embodiment.
Figure 6:
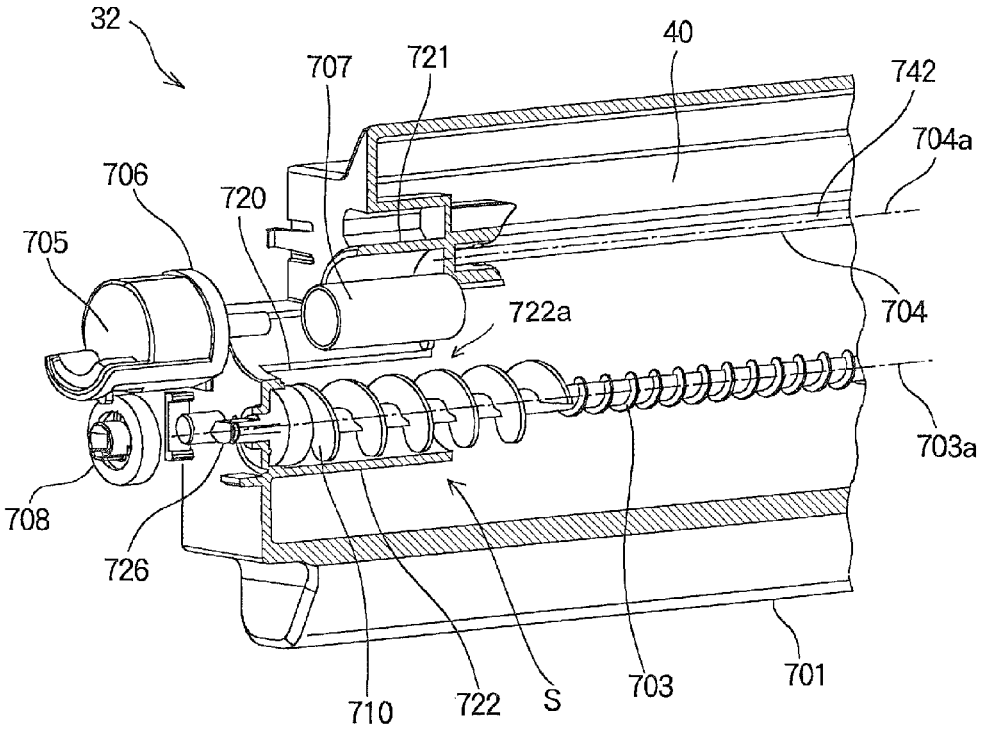
FIG. 6 is an enlarged view showing the vicinity of a waste toner receiving opening of the waste toner collecting container according to the first embodiment.
Figure 7:
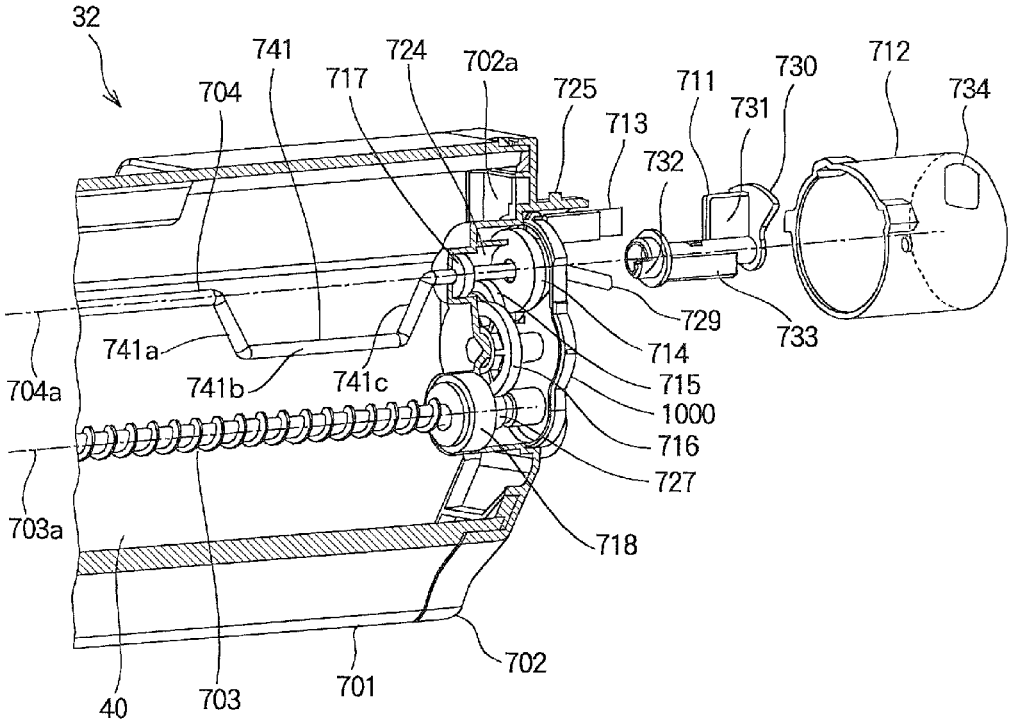
FIG. 7 is an enlarged view showing the vicinity of a driving portion of a waste toner full detection bar of the waste toner collecting container according to the first embodiment.
Figure 8:
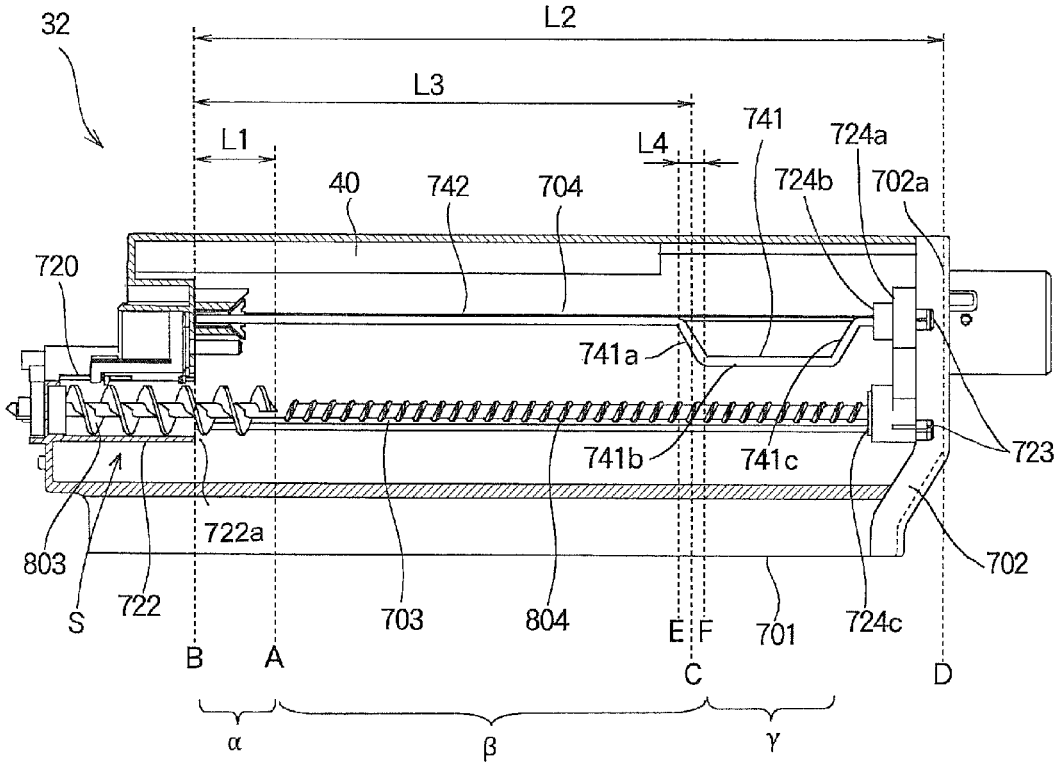
FIG. 8 is a sectional view showing an internal configuration of the waste toner collecting container according to the first embodiment.

FIG. 5 is a partially cut-away perspective view showing the waste toner collecting container 32 according to the first embodiment. FIG. 6 is an enlarged view showing the vicinity of the waste toner receiving opening 720 of the waste toner collecting container 32. FIG. 7 is an enlarged view showing the vicinity of a driving portion of a waste toner full detection bar 704 of the waste toner collecting container 32. FIG. 8 is a sectional view showing an internal configuration of the waste toner collecting container 32.

As shown in FIGS. 5 through 8, the waste toner collecting container 32 is elongated in the longitudinal direction of the developing units 2*k*, 2*c*, 2*m* and 2*y* (FIG. 2). The waste toner collecting container 32 includes an outer frame 701 and a side plate 702. The outer frame 701 is an outer wall (i.e., enclosure) of the waste toner collecting container 32. The side plate 702 is a side wall of the waste toner collecting container 32 on the same side as the second side frame 52 (FIG. 2). The outer frame 701 and the side plate 702 constitute a waste toner storage portion (i.e., a developer storage portion) 40 in which a waste toner is stored.

The outer frame 701 has the above described waste toner receiving opening 720 as a developer receiving portion for receiving the waste toner. The waste toner receiving opening 720 is connected to the waste toner ejecting portion 29 of the first side frame 51 shown in FIG. 2. Through the waste toner ejecting portion 29, the waste toner receiving opening 720 receives the waste toner having been conveyed by the second conveying mechanism 28. The waste toner receiving opening 720 is disposed on an end portion (i.e., a first end portion) of the waste toner collecting container 32 in the longitudinal direction.

A waste toner conveying spiral 703 (i.e., a developer conveying unit) is provided in the waste toner collecting container 32. The waste toner conveying spiral 703 is configured to convey the waste toner (which is collected via the waste toner receiving opening 720) in a direction toward the side plate 702. The waste toner conveying spiral 703 extends from a portion below the waste toner receiving opening 720 to reach the side plate 702. The waste toner conveying spiral 703 is supported so as to be rotatable about a rotation axis 703*a*, i.e., a center axis of the waste toner conveying spiral 703. A waste toner full detection bar 704 (i.e., a rotation member or a developer detecting unit) is provided above the waste toner conveying spiral 703.

A receiving opening shutter 705 and a shutter supporting portion 721 are formed on the outer frame 701. The receiving opening shutter 705 is configured to open and close the waste toner receiving opening 720. The shutter supporting portion 721 supports the receiving opening shutter 705 allowing the receiving opening shutter 705 to move. Further, a shutter seal member 706 is provided between the receiving opening shutter 705 and the shutter supporting portion 721. The shutter seal member 706 seals between the receiving opening shutter 705 and the shutter supporting portion 721. A spring 707 (FIG. 6) as a shutter biasing member is provided for biasing the receiving opening shutter 705 in a direction in which the receiving opening shutter 705 closes the waste toner receiving opening 720.

A conveying path 722 is provided below the waste toner receiving opening 720. The conveying path 722 has a substantially cylindrical shape, and is hereinafter referred to as a cylindrical conveying path 722. The cylindrical conveying path 722 is configured to guide the waste toner (fallen from the waste toner receiving opening 720) in a conveying direction, i.e., in a direction in which the waste toner conveying spiral 703 conveys the waste toner. A toner exit (i.e., a developer ejection opening) 722*a* is provided at an end of the cylindrical conveying path 722. The waste toner is ejected from the cylindrical conveying path 722 into the waste toner storage portion 40 via the toner exit 722*a*.

A part of the waste toner collecting container 32 including the waste toner receiving opening 720 and the cylindrical conveying path 722 is referred to as a toner introducing portion S (i.e., a developer ejecting portion). The waste toner is ejected from the toner introducing portion S into the waste toner storage portion 40.

An end portion of the waste toner collecting container 32 where the waste toner receiving opening 720 is disposed (i.e., on the waste toner receiving opening 720 side) is referred to as a first end portion. Another end portion of the waste toner collecting container 32 where the side plate 702 is disposed (i.e., on the side plate 702 side) is referred to as a second end portion.

Further, a side of the waste toner collecting container 32 where the waste toner receiving opening 720 is disposed is referred to as a conveyance starting side. Another side of the waste toner collecting container 32 where the side plate 702 is disposed is referred to as a conveyance termination side.

The waste toner conveying spiral 703 includes a gear engaging portion 726. The gear engaging portion 726 is provided at an end portion of the waste toner conveying spiral 703 located closer to the waste toner receiving opening 720. The gear engaging portion 726 engages a spiral driving gear 708 for rotating the waste toner conveying spiral 703. A rotation of the spiral driving gear 708 causes a rotation of the waste toner conveying spiral 703. A spiral shaft seal member 710 is provided on a shaft portion of the waste toner conveying spiral 703. The spiral shaft seal member 710 seals between the shaft portion of the waste toner conveying spiral 703 and the outer frame 701.

Claws 723 are provided at an end portion of the outer frame 701 located closer to the side plate 702. The claws 723 are formed to engage respective portions of the side plate 702. The side plate 702 has a wall surface 702*a* which forms an end portion of the waste toner storage portion 40 on the conveyance termination side.

As shown in FIG. 7, a waste toner full detection member 711, a detection member cover 712 and a chattering prevention film 713 are provided on an outer side of the side plate 702. The waste toner full detection member 711 (i.e., a detecting member) is configured to detect an accumulation state of the waste toner in the waste toner storage portion 40. The detection member cover 712 is formed to cover the waste toner full detection member 711. A cover mounting portion 725 is formed on the outer side of the side plate 702. The detection member cover 712 is mounted to the cover mounting portion 725. A gear housing cover 1000 is mounted to the side plate 702 by press-fitting. The gear housing cover 1000 is formed to cover driving gears described later.

A driving gear 714, a reduction gear 715 and another reduction gear 716 are rotatably provided on an inner side of the side plate 702. The driving gear 714 is provided for rotating the waste toner full detection bar 704. The reduction gear 715 engages the driving gear 714. The reduction gear 716 engages the reduction gear 715.

The driving gear 714 and the reduction gears 715 and 716 (i.e., driving gears) are housed in a gear housing 724 formed on the side plate 702, and are covered by the gear housing cover 1000 from outside. The driving gear 714, the reduction gears 715 and 716 are rotatably supported by the gear housing cover 1000. Shaft portions of the waste toner full detection bar 704 and the waste toner conveying spiral 703 penetrate a wall portion of the gear housing portion 724.

As shown in FIG. 8, the gear housing 724 includes a first wall surface 724*a*, a second wall surface 724*b* and a third wall surface 724*c*. The second wall surface 724*b* supports the shaft portion of the waste toner full detection bar 704. The third wall surface 724*c* supports the shaft portion of the waste toner conveying spiral 703. The wall surfaces 724*a*, 724*b* and 724*c* protrude inwardly into the waste toner storage portion 40 with respect to the wall surface 702*a* of the side plate 702. Protruding amounts of the wall surfaces 724*a*, 724*b* and 724*c* are different among one another. In other words, the waste toner storage portion 40 has an indented shape in the vicinity of the wall surfaces 724*a*, 724*b* and 724*c*.

Referring back to FIG. 7, a seal member 717 is provided on the shaft portion of the waste toner full detection bar 704. The seal member 717 seals between the shaft portion of the waste toner full detection bar 704 and the wall portion of the gear housing portion 724. A seal member 718 is provided on the shaft portion of the waste toner conveying spiral 703. The seal member 718 seals between the shaft portion of the waste toner conveying spiral 703 and the wall portion of the gear housing portion 724.

A gear portion 727 is provided at an end portion of the waste toner conveying spiral 703 on the conveyance termination side (i.e., located closer to the side plate 702). The gear portion 727 transmits the rotation of the waste toner conveying spiral 703 to the driving gears (i.e., the driving gear 714 and the reduction gears 715 and 716) for the waste toner full detection bar 704.

As shown in FIG. 8, the waste toner conveying spiral 703 has a first spiral portion 803 as a first portion or a developer pushing portion. The first spiral portion 803 extends a predetermined area of the waste toner conveying spiral 703 on the conveyance starting side. The waste toner conveying spiral 703 further has a second spiral portion 804 as a second portion. The second spiral portion 804 is located downstream of the first spiral portion 803 in the conveying direction of the waste toner.

The first spiral portion 803 extends from the vicinity of the end portion of the waste toner conveying spiral 703 on the conveyance starting side to reach a predetermined position (i.e., a terminating position) A. The terminating position A of the first spiral portion 803 is shifted inwardly into the waste toner storage portion 40 with respect to a position B of the toner exit 722*a* of the cylindrical conveying path 722 by a distance L1. In a particular example, the distance L1 is in a range from 10 mm to 20 mm, which corresponds to one pitch or two pitches of a spiral blade of the first spiral portion 803.

The first spiral portion 803 includes a rotation shaft (i.e., a first rotation shaft) and a spiral blade (i.e., a first spiral blade or a conveying blade) formed thereon. For example, the spiral blade of the first spiral portion 803 has a height in a range from 4 mm to 5 mm. The second spiral portion 804 includes a rotation shaft (i.e., a second rotation shaft) and a spiral blade (i.e., a second spiral blade) formed thereon. The spiral blade of the second spiral portion 804 has a height which is lower than the height of the spiral blade of the first spiral portion 803. For example, the spiral blade of the second spiral portion 804 has the height of approximately 1 mm. The spiral blade of the second spiral portion 804 hardly contributes to conveyance of the waste toner.

In this regard, the height of the spiral blade of the first spiral portion 803 corresponds to a protruding amount (i.e., a first protruding amount) of the spiral blade protruding from the rotation shaft of the first spiral portion 803. Similarly, the height of the spiral blade of the second spiral portion 804 corresponds to a protruding amount (i.e., a second protruding amount) of the spiral blade protruding from the rotation shaft of the second spiral portion 804. The second protruding amount is less than the first protruding amount.

The waste toner conveying spiral 703 is formed of resin material. The waste toner conveying spiral 703 receives a rotational force at the gear engaging portion 726, and transmits the rotational force to the waste toner full detection bar 704 via the gear portion 727. Since the waste toner conveying spiral 703 has the second spiral portion 804 that hardly contributes to the conveyance of the waste toner, a load (i.e., a rotational load) on the waste toner conveying spiral 703 can be reduced. Therefore, it is ensured that the waste toner conveying spiral 703 has sufficient torsion strength.

The waste toner full detection bar 704 includes a straight portion 742 extending in a direction substantially parallel to the rotation axis 703*a* of the waste toner conveying spiral 703. The waste toner full detection bar 704 further includes a crank portion 741 as a developer detecting portion provided on the conveyance termination side with respect to the straight portion 742. The waste toner full detection bar 704 is supported so as to be rotatable about a rotation axis 704*a*, i.e., a center axis of the straight portion 742.

The crank portion 741 includes an arm portion 741*a* extending radially outward from the straight portion 742. In a particular example, the arm portion 741*a* extends obliquely with respect to the straight portion 742. The crank portion 741 further includes a parallel portion 741*b* extending in a direction substantially parallel to the straight portion 742 from an end (i.e., a terminating position) of the arm portion 741*a*. The crank portion 741 further includes another arm portion 741*c* extending toward the rotation axis 704*a* from an end (i.e., a terminating position) of the parallel portion 741*b*. In a particular example, the arm portion 741*c* extends obliquely with respect to the straight portion 742.

A pushing area α, an accumulation area β and a detection area γ are provided in the waste toner storage portion 40. The pushing area α is an area in which the first spiral portion 803 of the waste toner conveying spiral 703 pushes the waste toner. The detection area γ is an area in which the crank portion 741 of the waste toner full detection bar 704 detects the waste toner. The accumulation area β is provided between the pushing area α and the detection area γ. The accumulation area β is an area in which the waste toner is accumulated. A length of the crank portion 741 (i.e., a length of the detection area γ) is smaller than or equal to a half (½) of a length of the second spiral portion 804 of the waste toner conveying spiral 703 (i.e., a sum of the lengths of the accumulation area β and the detection area γ).

The shaft portion of the waste toner full detection bar 704 penetrates the side plate 702. A hook portion 729 (i.e., a rotation transmitting portion) is provided at a tip portion of the shaft portion of the waste toner full detection bar 704. The hook portion 729 receives a rotation transmitted from the waste toner full detection member 711.

As described later, the waste toner full detection bar 704 is rotatable about the rotation axis 704*a*. When the crank portion 741 rotates from a bottom dead point (i.e., a lowermost point) to a top dead point (i.e., an uppermost point), the waste toner full detection bar 704 rotates together with the waste toner full detection member 711 by a rotational force transmitted via the driving gear 714. However, after the crank portion 741 passes the top dead point, the waste toner full detection bar 704 rotates to the bottom dead point by gravity due to a weight of the crank portion 741 together with the waste toner full detection member 711.

The crank portion 741 of the waste toner full detection bar 704 is provided on the conveyance termination side (i.e., on the side where the side plate 702 is disposed). When the waste toner accumulated in the waste toner storage portion 40 reaches the vicinity of a waste toner full detecting position C (FIG. 8) at an upstream end of the crank portion 741 in the conveying direction of the waste toner, the crank portion 741 contacts the waste toner. Therefore, the crank portion 741 is subjected to rotational resistance, which causes a change in a state of the rotation of the waste toner full detection bar 704 due to the weight of the crank portion 741.

In FIG. 8, L2 represents a distance from the position B (i.e., an exit position) of the toner exit 722*a* of the cylindrical conveying path 722 to a position D of the wall surface 702*a* of the side plate 702. L3 represents a distance from the exit position B of the cylindrical conveying path 722 to the waste toner full detecting position C. It is preferred that the distance L3 is longer than a half (½) of the distance L2 (i.e., L3>½×L2). Further, it is preferred that the crank portion 741 has a sufficient length (i.e., a crank length) so that the rotation of the waste toner full detection bar 704 (about the rotation axis 704*a*) is caused by gravity due to the weight of the crank portion 741. In a particular example, the distance L3 is approximately set to ⅔ of the distance L2 (i.e., L3≅⅔×L2).

Here, the waste toner full detecting position C is defined as an approximately intermediate position between a starting position E of the arm portion 741*a* (i.e., a border between the straight portion 742 and the arm portion 741*a*) and a terminating position F of the arm portion 741*a* (i.e., a border between the arm portion 741*a* and the parallel portion 741*b*). In other words, when a length of the arm portion 741*a* in the direction of the rotation axis 704*a* is represented by L4, the waste toner full detecting position C is so determined that a distance from the starting position E of the arm portion 741*a* to the waste toner full detecting position C is approximately the same as a half (½) of the length L4 (i.e., ½×L4).

In this regard, the waste toner full detecting position C can alternatively be determined as the starting position E or the terminating position F of the arm portion 741*a* in consideration of detection accuracy of the waste toner. Although the arm portions 741*a* and 741*c* are inclined with respect to the rotation axis 704*a* as shown in FIG. 8, it is also possible that the arm portions 741*a* and 741*c* are perpendicular to the rotation axis 704*a*. In such a case, the length L4 is 0.

The hook portion 729 of the waste toner full detection bar 704 is formed by bending the tip portion of the waste toner full detection bar 704 at an angle with respect to the rotation axis 704*a*. The hook portion 729 engages the waste toner full detection member 711. With an engagement between the hook portion 729 and the waste toner full detection member 711, the waste toner full detection member 711 and the waste toner full detection bar 704 rotate continuously together with each other.

The waste toner full detection bar 704 has a light reflecting portion 730 (FIG. 7) that reflects light emitted by a detection sensor 760 (FIG. 3) provided on a main body of the printer 1. The above described detection member cover 712 is formed to cover the waste toner full detection member 711, and has a substantially cylindrical shape. An opening 734 is formed on a part of the detection member cover 712 for allowing light emitted by the detection sensor 760 to pass. The waste toner full detection member 711 has a rib 731 that contacts the chattering prevention film 713 after the waste toner full detection member 711 rotates by gravity due to the weight of the crank portion 741.

The waste toner full detection member 711 has a rotation transmission rib 732 and a detection bar engaging portion 733. The rotation transmission rib 732 is configured to receive a rotational force transmitted from the driving gear 714. The detection bar engaging portion 733 is configured to engage the hook 729 to thereby transmit the rotational force to the waste toner full detection bar 704.

The detection sensor 760 shown in FIG. 3 is a reflective-type sensor, and has a light emitting portion and a light receiving portion. The light emitting portion of the detection sensor 760 emits light. When the light receiving portion of the detection sensor 760 receives light reflected by the light reflecting portion 730, the detection sensor 760 outputs "ON" signal. When the light receiving portion of the detection sensor 760 does not receive light, the detection sensor 760 outputs "OFF" signal.

Figure 9A:
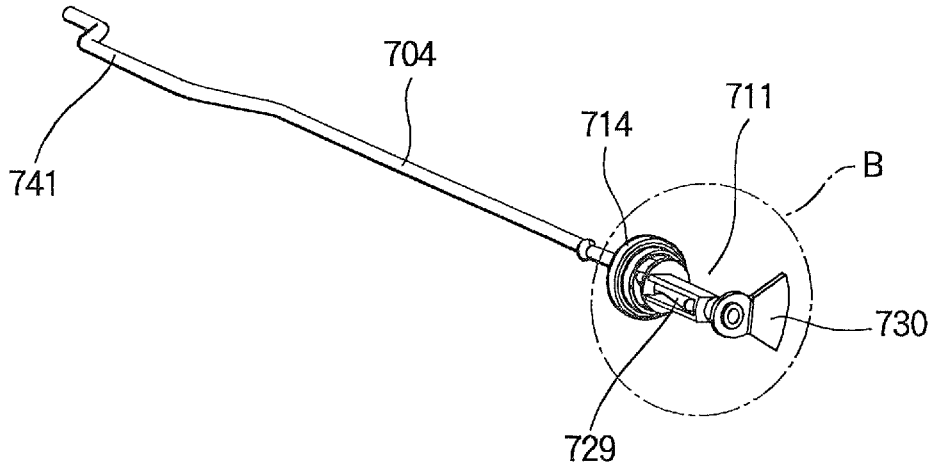
FIG. 9A is a perspective view showing the waste toner full detection bar, a driving gear and a waste toner full detection member according to the first embodiment.
Figure 9B:
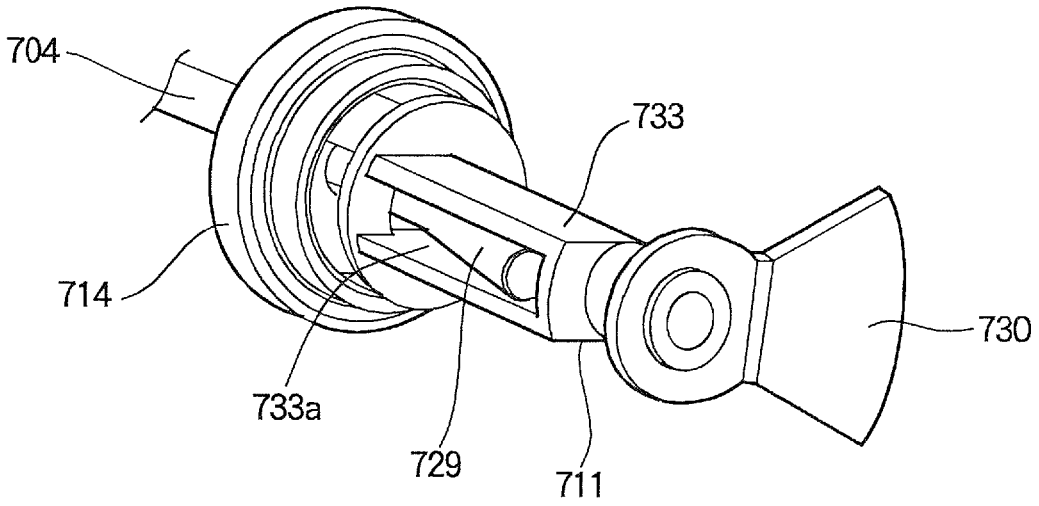
FIG. 9B is an enlarged perspective view showing a part encircled by a circle B in FIG. 9A.
Figure 10A:
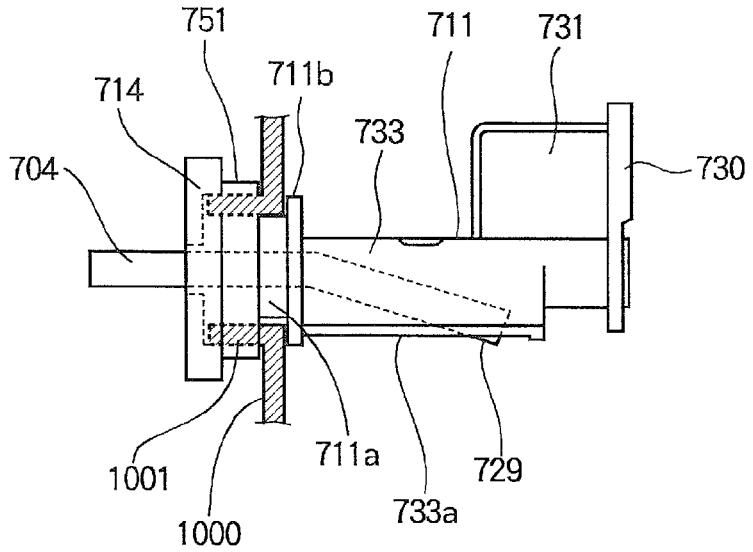
FIGS. 10A and 10B are a front view and an exploded perspective view showing a coupling portion of the waste toner full detection bar, the driving gear and the waste toner full detection member according to the first embodiment.
Figure 10B:
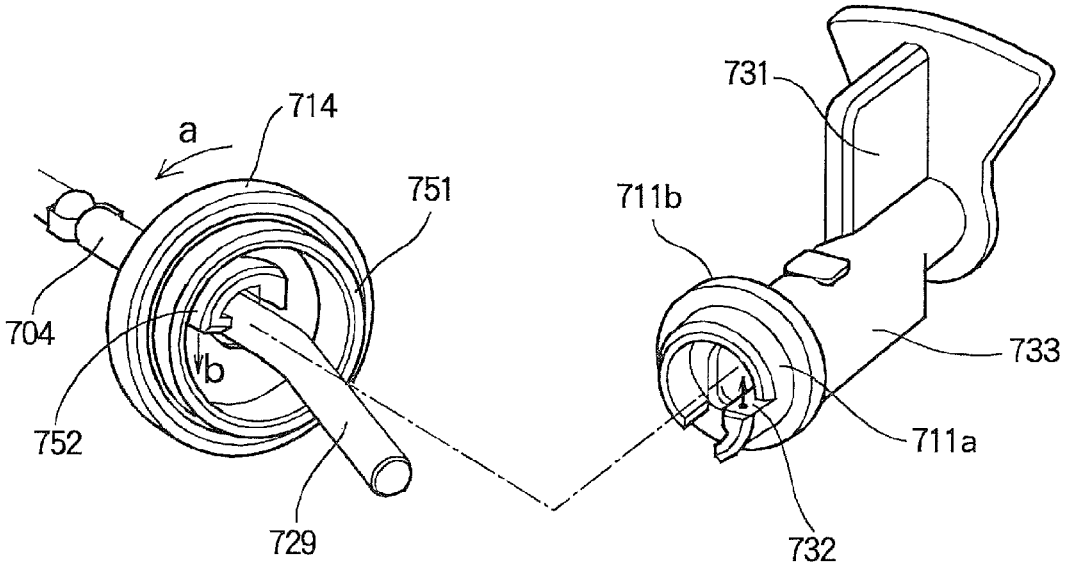

FIG. 9A is a perspective view showing the waste toner full detection bar 704, the driving gear 714 and the waste toner full detection member 711. FIG. 9B is an enlarged perspective view showing a part encircled by a circle B in FIG. 9A. FIGS. 10A and 10B are a front view and an exploded perspective view showing a coupling portion of the waste toner full detection bar 704, the driving gear 714 and the waste toner full detection member 711.

As shown in FIGS. 9A and 9B, the waste toner full detection bar 704 penetrates the driving gear 714. The tip portion of the waste toner full detection bar 704 penetrating the driving gear 714 is bent, and forms the hook portion 729. As shown in FIG. 9B, the waste toner full detection member 711 has the detection bar engaging portion 733 having a concave portion 733*a*. The hook 729 of the waste toner full detection bar 704 engages the concave portion 733*a* of the detection bar engaging portion 733. With an engagement of the hook 729 and the concave portion 733*a*, the waste toner full detection member 711 and waste toner full detection bar 704 rotate together with each other.

As shown in FIGS. 10A and 10B, the driving gear 714 has a coaxial annular portion 751 that slidably engages an outer circumference of a shaft receiving portion 1001 of the gear housing cover 1000. The driving gear 714 has a rotation transmission rib 752 inside the annular portion 751. The waste toner full detection member 711 has a cylindrical portion 711*a* and a flange portion 711*b*. The cylindrical portion 711*a* is coaxial with the annular portion 751 of the driving gear 714, and slidably engages an inner circumference of the shaft receiving portion 1001 of the gear housing cover 1000. The flange portion 711*b* contacts a side surface of the gear housing cover 1000. The cylindrical portion 711*a* has a rotation transmission rib 732.

The rotation transmission rib 732 contacts the rotation transmission rib 752 of the driving gear 714 when the driving gear 714 rotates in a direction shown by an arrow "a" shown in FIG. 10B (i.e., when the rotation transmission rib 752 rotates in a direction shown by an arrow "b").

When the driving gear 714 rotates in a direction shown by the arrow "a", the rotation transmission rib 752 of the driving gear 714 contacts the rotation transmission rib 732 and pushes the rotation transmission rib 732 in the direction shown by the arrow "b". Therefore, a rotation of the driving gear 714 is transmitted to the waste toner full detection member 711, and the waste toner full detection member 711 rotates in the same direction as the driving gear 714. Further, the waste toner full detection bar 704 rotates in the same direction as the waste toner full detection member 711 by the engagement between the hook portion 729 and the concave portion 733*a*. That is, the waste toner full detection member 711 and the waste toner full detection bar 704 rotate together with each other.

During the rotation of the waste toner full detection member 711 and the waste toner full detection bar 704, when the crank portion 741 passes the top dead point (i.e., the uppermost point of its rotation range), the rotation transmission rib 732 of the waste toner full detection member 711 separates from the rotation transmission rib 752 of the driving gear 714. Then, the waste toner full detection bar 704 and the waste toner full detection member 711 rotate downward by gravity due to the weight of the crank portion 741.

In other words, the waste toner full detection bar 704 and the waste toner full detection member 711 are configured to freely rotate downward from the top dead point by gravity due to the weight of the crank portion. 741. In this embodiment, an accumulation state of the waste toner is determined based on a rotational state of the waste toner full detection bar 704 and the waste toner full detection member 711 while the waste toner full detection bar 704 and the waste toner full detection member 711 rotate downward by gravity.

A basic operation of the printer 1 according to the first embodiment will be described with reference to FIG. 1. The media (for example, the printing sheets) stored in the medium feeding unit 6 are fed out therefrom one by one, and each medium is fed along the feeding path to reach the transfer unit 4. Then, the medium is absorbed and held by the transfer belt 41, and fed by the transfer belt 41 through the developing units 2*k*, 2*c*, 2*m* and 2*y*.

In the black developing unit 2*k*, the black toner replenished by the toner cartridge 3*k* is supplied to the developing roller 23*k* via the supplying roller 25*k*. The toner layer with a uniform thickness is formed on the surface of the developing roller 23*k* by the developing blade 24*k*. The surface of the photosensitive drum 21*k* is uniformly charged by the charging roller 22*k*, and is exposed with light emitted by the LED head 25*k*, so that a latent image is formed on the surface of the photosensitive drum 21*k*. The latent image is developed with the toner on the surface of the developing roller 23*k*, and a black toner image is formed on the surface of the photosensitive drum 21*k*. The black toner image is transferred from the surface of the photosensitive drum 21*k* to the surface of the medium on the transfer belt 41 when the medium passes between the photosensitive drum 21*k* and the transfer roller 40*k*.

Similarly, cyan, magenta and yellow toner images are respectively formed by the developing unit 2*c*, 2*m* and 2*y*, and are transferred to the surface of the medium.

The medium to which the toner images of the respective colors are transferred is fed by the transfer belt 41 to the fixing unit 7. The fixing unit 7 applies heat and pressure to the medium so as to fix the toner image to the medium. The medium to which the toner image is fixed is ejected outside the printer 1, and formation of the toner image on the medium is completed.

In the above described process, the toner may remain on the surfaces of the photosensitive drums 21*k*, 21*c*, 21*m* and 21*y*. Such a toner is removed by the cleaning blades 26*k*, 26*c*, 26*m* and 26*y*. The toner (i.e., the waste toner) removed by the cleaning blades 26*k*, 26*c*, 26*m* and 26*y* is collected by the first conveying mechanism 27*k*, 27*c*, 27*m* and 27*y*. The waste toner conveyed by the first conveying mechanism 27*k*, 27*c*, 27*m* and 27*y* is further conveyed by the second conveying mechanism 28 to the waste toner collecting container 32.

Figure 11:
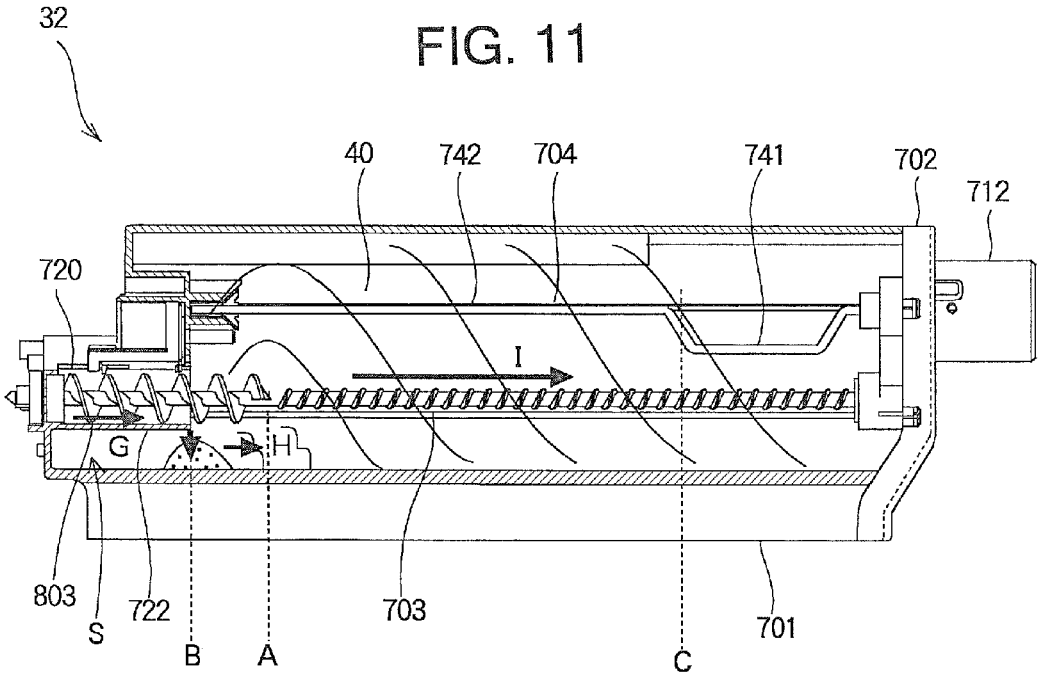
FIG. 11 is a sectional view showing a manner in which the waste toner is conveyed and accumulated in the waste toner collecting container according to the first embodiment.
Figure 12:
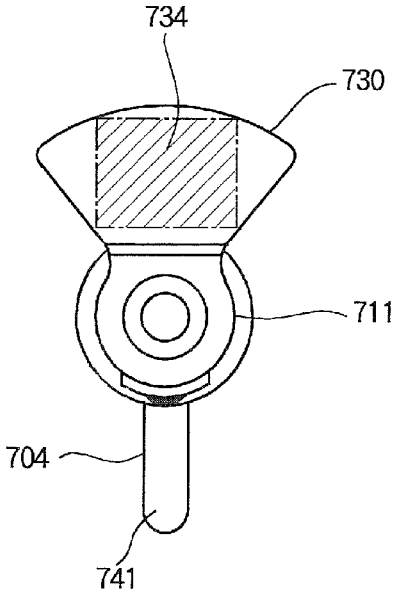
FIG. 12 is a schematic view showing an operation to detect a waste toner full state according to the first embodiment.

FIG. 11 is a sectional view showing a manner in which the waste toner is conveyed and accumulated in the waste toner collecting container 32 according to the first embodiment. As shown in FIG. 11, the waste toner having been conveyed by the second conveying mechanism 28 is collected into the waste toner collecting container 32 via the waste toner receiving opening 720.

While the printer 1 is performing the image forming operation, the waste toner conveying spiral 703 keeps rotating. The rotation of the waste toner conveying spiral 703 is transferred to the waste toner full detection member 711 and the waste toner full detection bar 704, and therefore the waste toner full detection member 711 and the waste toner full detection bar 704 also keep rotating. In this regard, after the crank portion 741 passes the top dead point, the waste toner full detection member 711 and the waste toner full detection bar 704 freely rotate downward to the bottom dead point by gravity due to the weight of the crank portion 741.

As the waste toner conveying spiral 703 rotates, the waste toner is conveyed by the first spiral portion 803 along the cylindrical conveying path 722 in the direction shown by an arrow G. The waste toner is ejected from the cylindrical conveying path 722 via the toner exit 722*a*, and is accumulated at the exit position B in a mound shape. The waste toner is accumulated at a height lower than the first spiral portion 803. The accumulation of the waste toner proceeds in a direction shown by an arrow H.

When the accumulated waste toner reaches the terminating position A of the first spiral portion 803 of the waste toner conveying spiral 703, the waste toner is accumulated in a mound shape beyond the height of the first spiral portion 803. The accumulation of the waste toner proceeds in a direction shown by an arrow I.

As the amount of the waste toner in the waste toner storage portion 40 increases, the straight portion 742 of the rotating waste toner full detection bar 704 is buried in the waste toner. Further, when the accumulated waste toner reaches the waste toner full detecting position C, the crank portion 741 is subjected to rotational resistance, which causes a change in a rotational state of the waste toner full detection bar 704. The crank portion 741 is disposed in an area of the conveyance termination side of the waste toner storage portion 40 as described above.

In this regard, a method for detecting the change in the rotational state of the waste toner full detection bar 704 will be described. FIGS. 12 through 15 are schematic views showing the waste toner full detection member 711 as seen in a direction shown by an arrow D in FIG. 8.

The waste toner full detection bar 704 and the waste toner full detection member 711 rotate in the direction shown by the arrow "a" (i.e., counterclockwise) by the rotation of the driving gear 714. When the crank portion 741 of the waste toner full detection bar 704 is in the bottom dead point of its rotation range, the light reflection portion 730 of the waste toner full detection member 711 is in a top dead point of its rotation range. In this state, the light reflecting portion 730 faces the opening 734 (shown with hatching in FIGS. 12 through 15) of the detection member cover 712 (FIG. 7), and reflects light emitted by the detection sensor 760. Therefore, the detection sensor 760 outputs "ON" signal.

Figure 13:
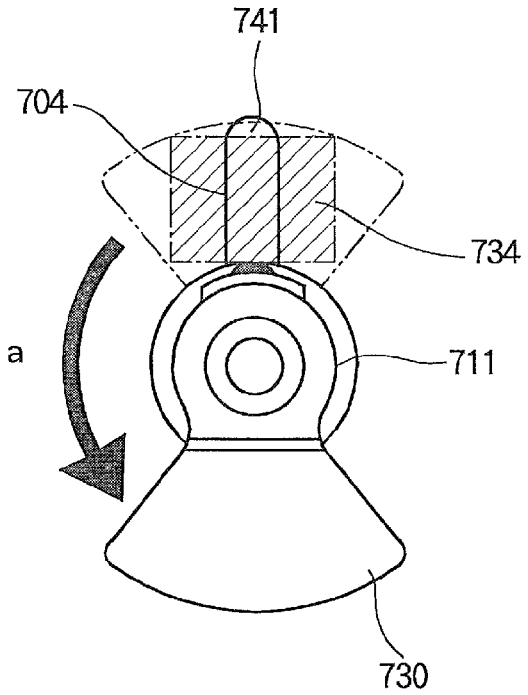
FIG. 13 is a schematic view showing the operation to detect the waste toner full state according to the first embodiment.

Then, the waste toner full detection bar 704 and the waste toner full detection member 711 rotate in the direction shown by the arrow "a" (i.e., counterclockwise) at a predetermined speed by the rotation of the driving gear 714, and the crank portion 741 reaches the top dead point as shown in FIG. 13. When the crank portion 741 passes the top dead point, the waste toner full detection bar 704 and the waste toner full detection member 711 rotate downward by gravity due to the weight of the crank portion 741. Therefore, engagement between the rotation transmission rib 732 of the waste toner full detection member 711 and the rotation transmission rib 752 (FIG. 10B) of the driving gear 714 is released.

Figure 14:
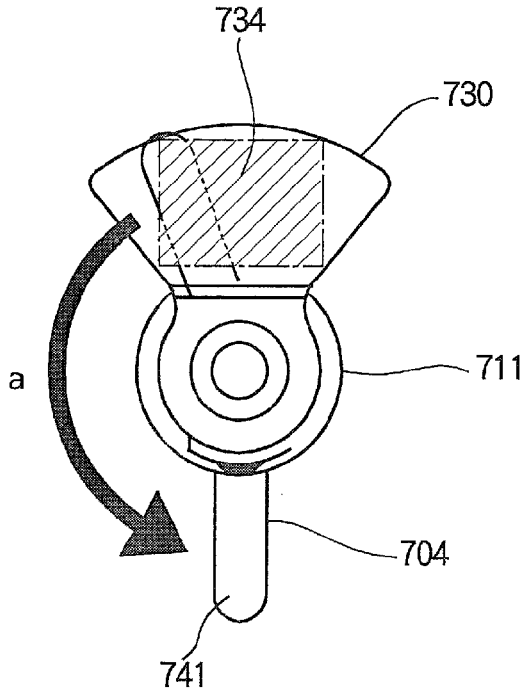
FIG. 14 is a schematic view showing the operation to detect the waste toner full state according to the first embodiment.

In a state where the waste toner is not yet accumulated to a disposition area of the crank portion 741 (i.e., an area in which the crank portion 741 is disposed), the waste toner full detection bar 704 and the waste toner full detection member 711 rotate from the top dead point to the bottom dead point by gravity (due to the weight of the crank portion 741) as shown in FIG. 14. Then, the driving gear 714 further rotates, and the rotation transmission rib 752 (FIG. 10B) of the driving gear 714 again contacts the rotation transmission rib 732 of the waste toner full detection member 711. Therefore, the waste toner full detection bar 704 and the waste toner full detection member 711 start rotating at the constant speed.

Figure 15:
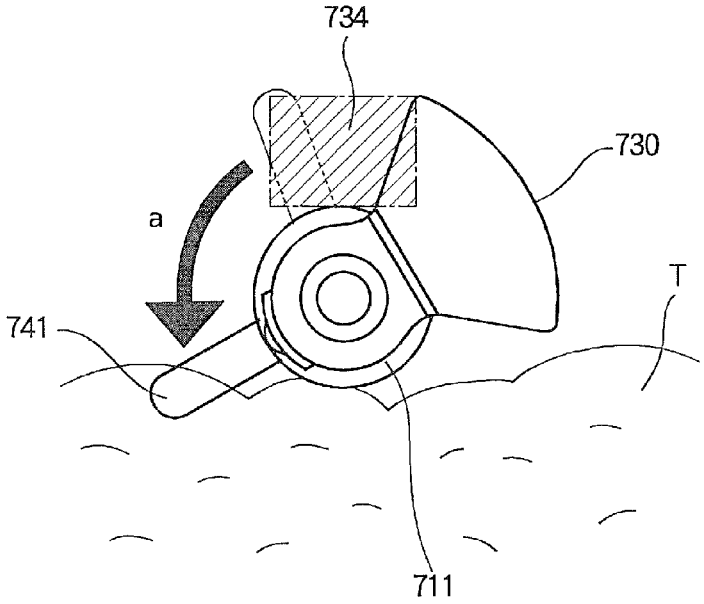
FIG. 15 is a schematic view showing the operation to detect the waste toner full state according to the first embodiment.

In contrast, in a state where the waste toner is accumulated to the disposition area of the crank portion 741 (for example, a height of the crank portion 741), the waste toner full detection bar 704 and the waste toner full detection member 711 rotate downward by gravity (due to the weight of the crank portion 741) as shown in FIG. 15. However, the crank portion 741 is subjected to rotational resistance from the accumulated waste toner T, and therefore the waste toner full detection bar 704 and the waste toner full detection member 711 stop rotating before the crank portion 741 reaches the bottom dead point.

Then, the driving gear 714 further rotates, and the rotation transmission rib 752 (FIG. 10B) of the driving gear 714 again contacts the rotation transmission rib 732 of the waste toner full detection member 711. Therefore, the waste toner full detection bar 704 and the waste toner full detection member 711 start rotating at the constant speed.

In this case, the light reflecting portion 730 of the waste toner full detection member 711 passes the opening 734 of the detection member cover 712 at a constant speed. Therefore, a duration time of "ON" signal outputted by the detection sensor 760 (i.e., a time interval during which the detection sensor 760 receives reflection light) becomes shorter than in the case where the waste toner is not accumulated to the disposition area of the crank portion 741 (FIG. 14). Further, a starting timing of the "ON" signal is delayed as compared with the case where the waste toner is not accumulated to the disposition area of the crank portion 741 (FIG. 14).

Figure 16A:
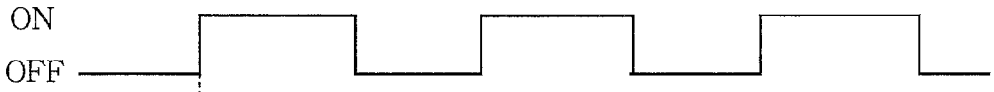
FIG. 16A is a timing chart showing an output of a detection sensor when the waste toner is not yet accumulated to a position of a crank portion according to the first embodiment.
Figure 16B:
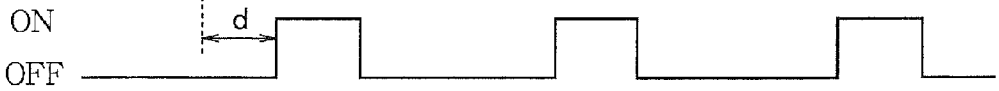
FIG. 16B is a timing chart showing the output of the detection sensor when the waste toner is accumulated to the position of the crank portion according to the first embodiment.

FIG. 16A is a timing chart showing an output (ON/OFF) of the detection sensor 760 in the case where the waste toner is not accumulated to the disposition area of the crank portion 741. FIG. 16B is a timing chart showing the output of the detection sensor 760 in the case where the waste toner is accumulated to the disposition area of the crank portion 741.

In the case where the waste toner is not accumulated to the disposition area of the crank portion 741, after the crank portion 741 passes the top dead point (FIG. 13), the waste toner full detection bar 704 and the waste toner full detection member 711 rotate by gravity due to the weight of the crank portion 741. The crank portion 741 reaches the bottom dead point in a short time, and the light reflecting portion 730 of the waste toner full detection member 711 reaches a position facing the opening 734, and the detection sensor 760 outputs "ON" signal as shown in FIG. 16A.

Thereafter, as the driving gear 714 further rotates at the constant speed, the rotation transmission rib 752 (FIG. 10B) again contacts the rotation transmission rib 732 of the waste toner full detection member 711, so that the waste toner full detection bar 704 and the waste toner full detection member 711 start rotating at the constant speed. The light reflecting portion 730 of the waste toner full detection member 711 leaves the position facing the opening 734, and the detection sensor 760 outputs "OFF" signal. These motions are repeated in the case where the accumulated waste toner does not reach the disposition area of the crank portion 741.

In contrast, in the case where the waste toner is accumulated to the disposition area of the crank portion 741, after the crank portion 741 passes the top dead point (FIG. 13), the waste toner full detection bar 704 and the waste toner full detection member 711 start rotating by gravity due to the weight of the crank portion 741. However, the waste toner full detection bar 704 and the waste toner full detection member 711 stop rotating since the crank portion 741 contacts the accumulated waste toner.

Thereafter, as the driving gear 714 further rotates at the constant speed, the rotation transmission rib 752 (FIG. 10B) again contacts the rotation transmission rib 732 of the waste toner full detection member 711, so that the waste toner full detection bar 704 and the waste toner full detection member 711 start rotating at the constant speed. The light reflecting portion 730 of the waste toner full detection member 711 reaches the position facing the opening 734, and the detection sensor 760 outputs "ON" signal as shown in FIG. 16B.

Therefore, the starting timing at which the detection sensor 760 outputs "ON" signal is delayed as compared with the case where the waste toner is not accumulated to the disposition area of the crank portion 741. That is, there is a difference "d" in starting timing of "ON" signal between two cases shown in FIGS. 16A and 16B. Further, there is the same difference "d" in the duration time of "ON" signal between two cases shown in FIGS. 16A and 16B.

Accordingly, it becomes possible to detect that the waste toner (having been conveyed in the direction shown by the arrow I in the waste toner storage portion 40) is accumulated to the disposition area of the crank portion 741 based on the starting timing or the duration time of "ON" signal of the detection sensor 760. In other words, a waste toner full state of the waste toner storage portion 40 can be detected based on the starting timing or the duration time of "ON" signal of the detection sensor 760.

After the waste toner full state is detected as described above, the waste toner is further accumulated in the detection area γ of the waste toner storage portion 40 (where the crank portion 741 is provided) before the waste toner collecting container 32 is replaced by a user.

As described above, according to the first embodiment of the present invention, the waste toner conveying spiral 703 coveys the waste toner from the first end portion of the waste toner storage container 32 (where the waste toner receiving opening 720 is disposed) toward the second end portion of the waste toner storage container 32 opposite to the first end portion. Further, the crank portion 741 is located closer to the second end portion than to the first end portion. With such a configuration, the accumulation of the waste toner gradually proceeds in a direction from the first end portion toward the second end portion. Therefore, at a stage where the accumulated waste toner reaches the disposing area of the crank portion 741 (located closer to the second end portion than to the first end portion), the waste toner storage container 32 is almost filled with the waste toner.

Accordingly, a sufficient amount of the waste toner can be stored in the waste toner collecting container 32. That is, a capacity of the waste toner storage portion 40 can be effectively used. Moreover, the accumulation of the waste toner is detected before the waste toner collecting container 32 is completely filled with the waste toner, and therefore leakage of the waste toner can be prevented.

Moreover, the waste toner storage container 32 includes the pushing area α in which the waste toner is conveyed by the first spiral portion 803, and the detection area γ in which the waste toner is detected by the crank portion 741. The accumulation area β in which the waste toner is accumulated provided between the pushing area α and the detection area γ. With such a configuration, the waste toner can be effectively stored in the waste toner collecting container 32 before the waste toner full state is detected.

In addition, it becomes possible to arbitrarily adjust a time interval after the accumulation of the waste toner is detected and before the waste toner collecting container 32 is completely filled with the waste toner, by adjusting the waste toner full detecting position C (i.e., the length of the crank portion 741).

Further, the first (upstream) spiral portion 803 of the waste toner conveying spiral 703 pushes the waste toner with a larger force, while the second (downstream) spiral portion 804 of the waste toner conveying spiral 703 pushes the waste toner with a smaller force. To be more specific, the second spiral portion 804 has almost no conveying capacity. Therefore, the waste toner conveying spiral 703 is only subjected to a load required for the first spiral portion 803 to push the waste toner. Further, the waste toner is not agglomerated by being pressed against the wall surface of the side plate 702 until the accumulated waste toner reaches the wall surface of the side plate 702. Accordingly, an increase in load (torque) on the waste toner conveying spiral 703 can be suppressed.

Furthermore, the length of the crank portion 741 is shorter than or equal to a half (½) of the second spiral portion 804 of the waste toner conveying spiral 703, and therefore the capacity of the waste toner storage portion 40 can be used at a maximum. The reason is described below. In order to use the capacity of the waste toner storage portion 40 at a maximum, it is necessary to calculate the accumulation state of the waste toner (i.e., whether the waste toner storage portion 40 is filled with the waste toner) after the waste toner full state is detected, but a calculation value may have a variation. According to the first embodiment of the present invention, since a large amount of the waste toner is stored in the waste toner storage portion 40 at timing when the waste toner full state is detected, it becomes possible to use the capacity of the waste toner storage portion 40 at a maximum even in consideration of the variation.

Moreover, the waste toner full detection bar 704 having the crank portion 741 constitutes the developer detecting portion. The rotation of the waste toner full detection bar 704 is optically detected. Therefore, the accumulation state of the waste toner is accurately detected based on the change in the rotational state of the waste toner full detection bar 704.

In addition, the waste toner full detection bar 704 is provided above the waste toner conveying spiral 703, and therefore the accumulation state of the waste toner can be detected with a simple configuration. In this regard, the waste toner full detection bar 704 is not necessarily provided directly above the waste toner conveying spiral 703. It is only necessary that the waste toner full detection bar 704 is provided at a higher position than the waste toner conveying spiral 703.

Second Embodiment

Figure 17:
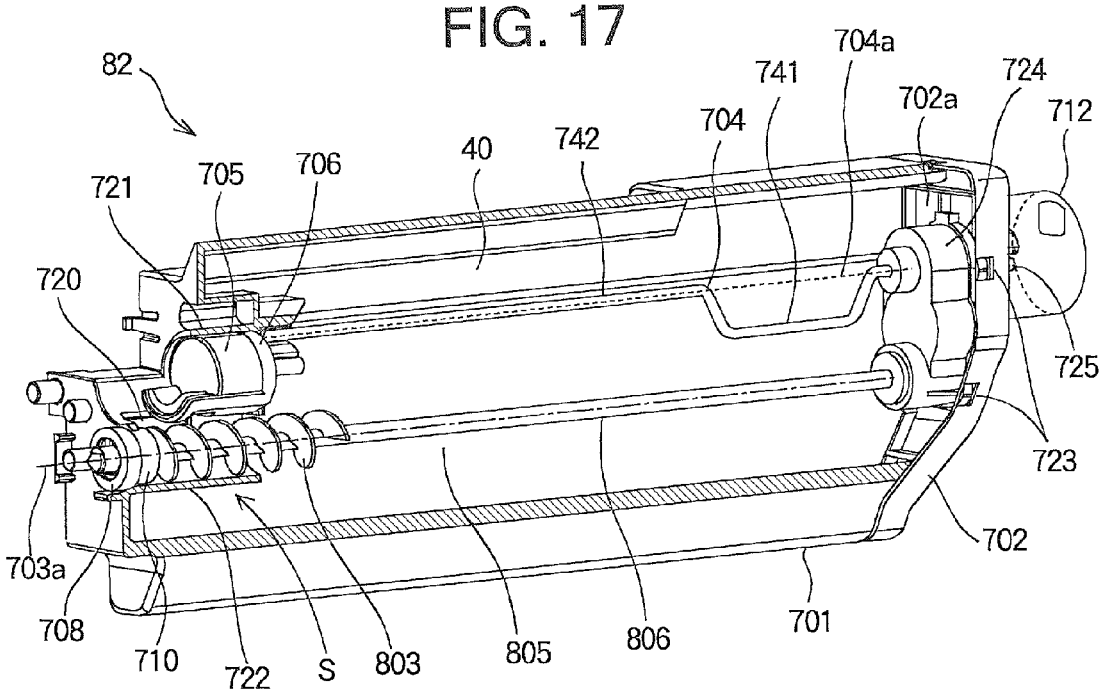
FIG. 17 is a partially cut-away perspective view showing a waste toner collecting container according to the second embodiment of the present invention.
Figure 18:
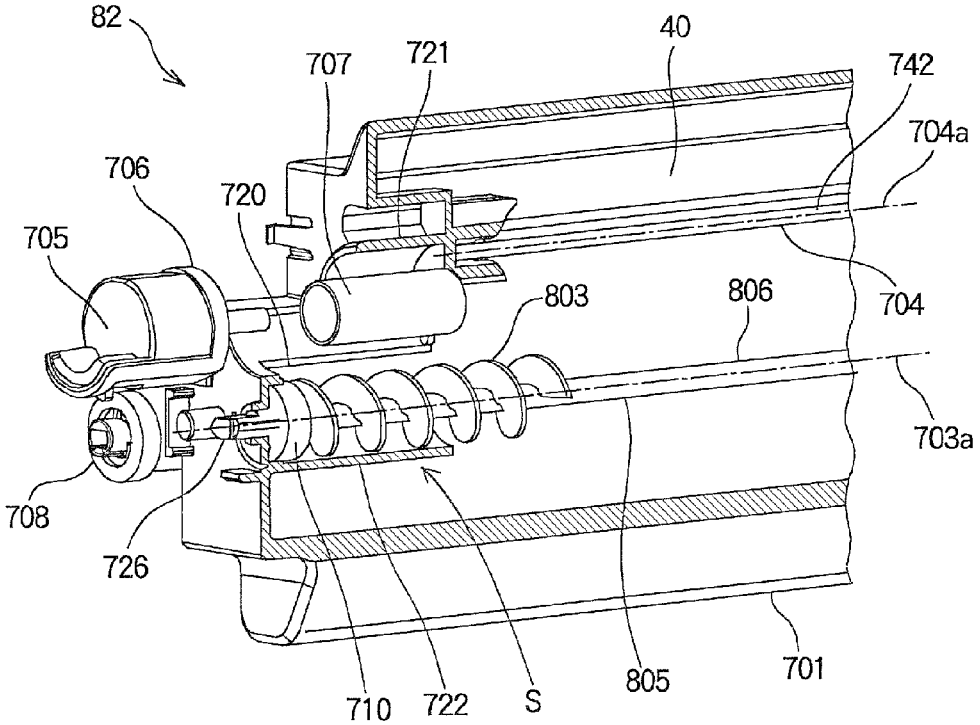
FIG. 18 is an enlarged view showing the vicinity of a waste toner receiving opening of the waste toner collecting container according to the second embodiment.
Figure 19:
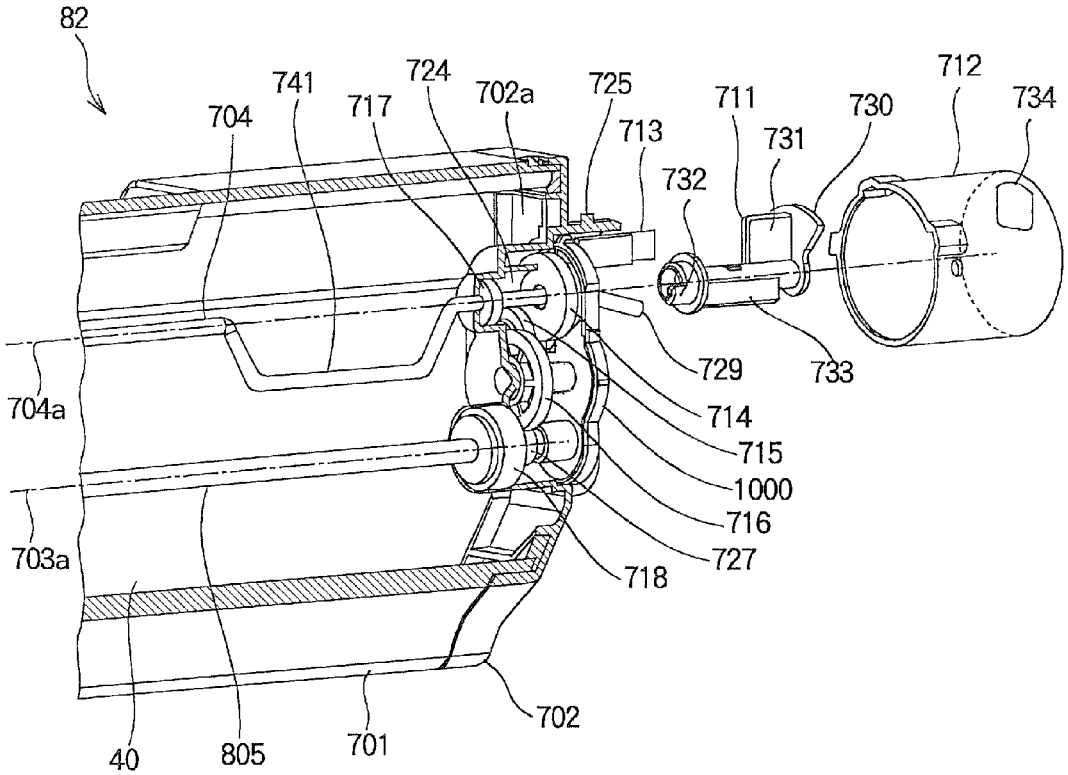
FIG. 19 is an enlarged view showing the vicinity of a waste toner full detection bar of the waste toner collecting container according to the second embodiment.
Figure 20:
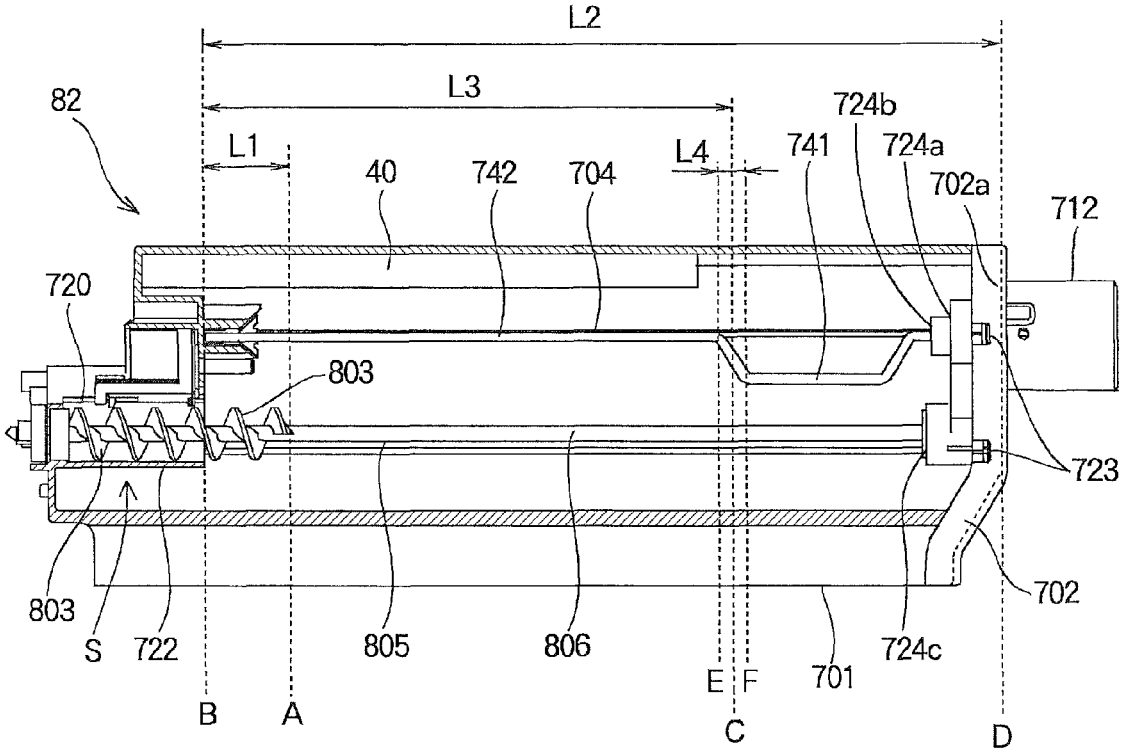
FIG. 20 is a sectional view showing an internal configuration of the waste toner collecting container according to the second embodiment.

Next, the second embodiment of the present invention will be described. FIG. 17 is a partially cut-away perspective view showing a waste toner collecting container 82 according to the second embodiment. FIG. 18 is an enlarged view showing the vicinity of a waste toner receiving opening 720 of the waste toner collecting container 82. FIG. 19 is an enlarged view showing the vicinity of a driving portion of a waste toner full detection bar 704 of the waste toner collecting container 82. FIG. 20 is a sectional view showing an internal configuration of the waste toner collecting container 82. In these figures, components that are the same as those of the first embodiment are assigned the same reference numerals.

The waste toner collecting container 82 of the second embodiment is different from the waste toner collecting container 32 of the first embodiment in configuration of the waste toner conveying spiral 805. Further, an electrophotographic printer (hereinafter referred to as a printer) of the second embodiment is configured in a similar manner to the printer 1 of the first embodiment except for the waste toner collecting container 82.

The waste toner conveying spiral 805 of the second embodiment has a non-spiral portion 806 instead of the second spiral portion 804 (FIG. 5) of the waste toner conveying spiral 703 of the first embodiment. The non-spiral portion 806 has no spiral blade. That is, the waste toner conveying spiral 805 of the second embodiment has a first spiral portion 803 (i.e., a first portion) and a non-spiral portion 806 (i.e., a second portion) having no spiral portion.

The first spiral portion 803 extends from the vicinity of the end portion of the waste toner conveying spiral 805 on the conveyance starting side (i.e., the end portion where the waste toner receiving opening 720 is disposed) to a terminating position A. The terminating position A is shifted inwardly into the waste toner storage portion 40 with respect to the exit position B of the cylindrical conveying path 722. The terminating position A is distanced from the exit position B by a distance L1. In a particular example, the distance L1 is set in a range from 10 mm to 20 mm, which corresponds to one pitch or two pitches of the spiral blade of the first spiral portion 803.

The first spiral portion 803 has the spiral blade having the height described in the first embodiment. The non-spiral portion 806 has no spiral blade, and does not contribute to conveyance of the waste toner. Since the non-spiral portion 806 does not contribute to conveyance of the waste toner, it becomes possible to eliminate a load on the non-spiral portion 806 due to resistance from the waste toner. Other configurations of the second embodiment are the same as those of the first embodiment.

Figure 21:
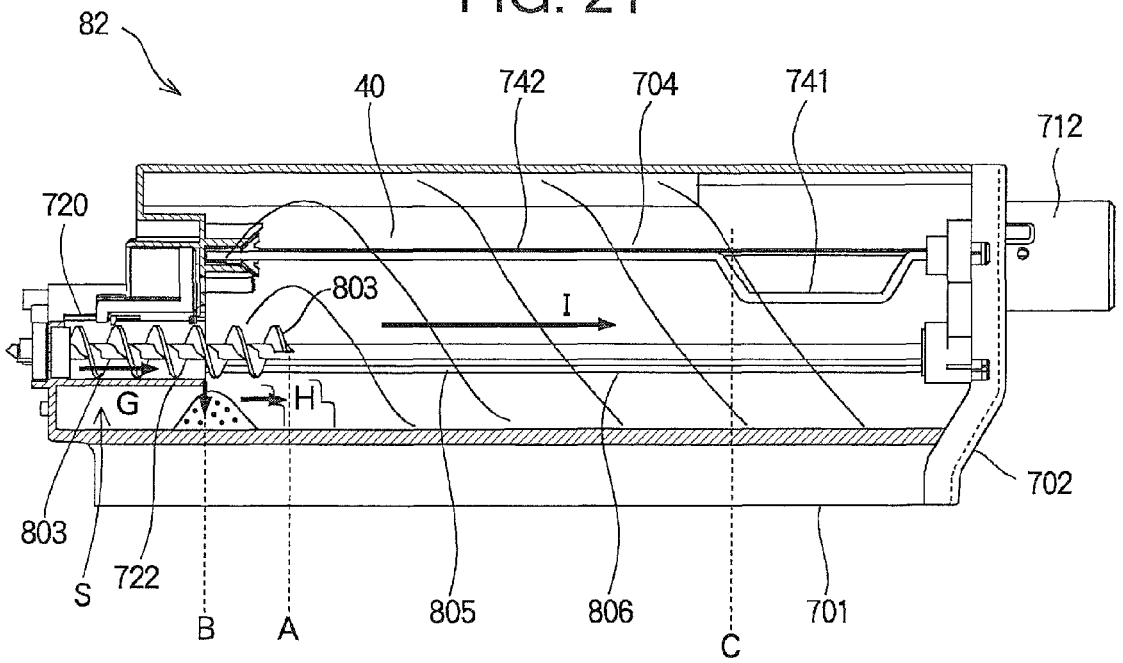
FIG. 21 is a sectional view showing a manner in which the waste toner is conveyed and accumulated in the waste toner collecting container according to the second embodiment.

FIG. 21 is a sectional view showing a manner in which the waste toner is conveyed and accumulated in the waste toner collecting container 82 according to the second embodiment. The waste toner collected into the waste toner collecting container 82 is conveyed by the first spiral portion 803 of the waste toner conveying spiral 805 along the cylindrical conveying path 722 in the direction shown by the arrow G. The waste toner is ejected from the cylindrical conveying path 722 via the toner exit 722*a*, and is accumulated at the exit position B in a mound shape. The waste toner is accumulated at a height lower than the first spiral portion 803. The accumulation of the waste toner proceeds in the direction shown by the arrow H.

When the accumulated waste toner reaches the terminating position A of the first spiral portion 803 of the waste toner conveying spiral 805, the waste toner is accumulated in a mound shape beyond the height of the first spiral portion 803. The accumulation of the waste toner proceeds in the direction shown by the arrow I.

As the amount of the waste toner in the waste toner storage portion 40 increases, the straight portion 742 of the rotating waste toner full detection bar 704 is buried in the waste toner. Further, when the accumulated waste toner reaches the waste toner full detecting position C, the crank portion 741 is subjected to rotational resistance, which causes a change in a rotational state of the waste toner full detection bar 704. The change in the rotational state of the waste toner full detection bar 704 is detected as described in the first embodiment.

As described above, according to the second embodiment, the waste toner conveying spiral 805 includes the non-spiral portion 806 at a downstream part thereof in the conveying direction of the waste toner. Therefore, the non-spiral portion 806 is not subjected to resistance from the waste toner, and an increase in load (torque) on the waste toner conveying spiral 805 can be suppressed.

Third Embodiment

Figure 22:
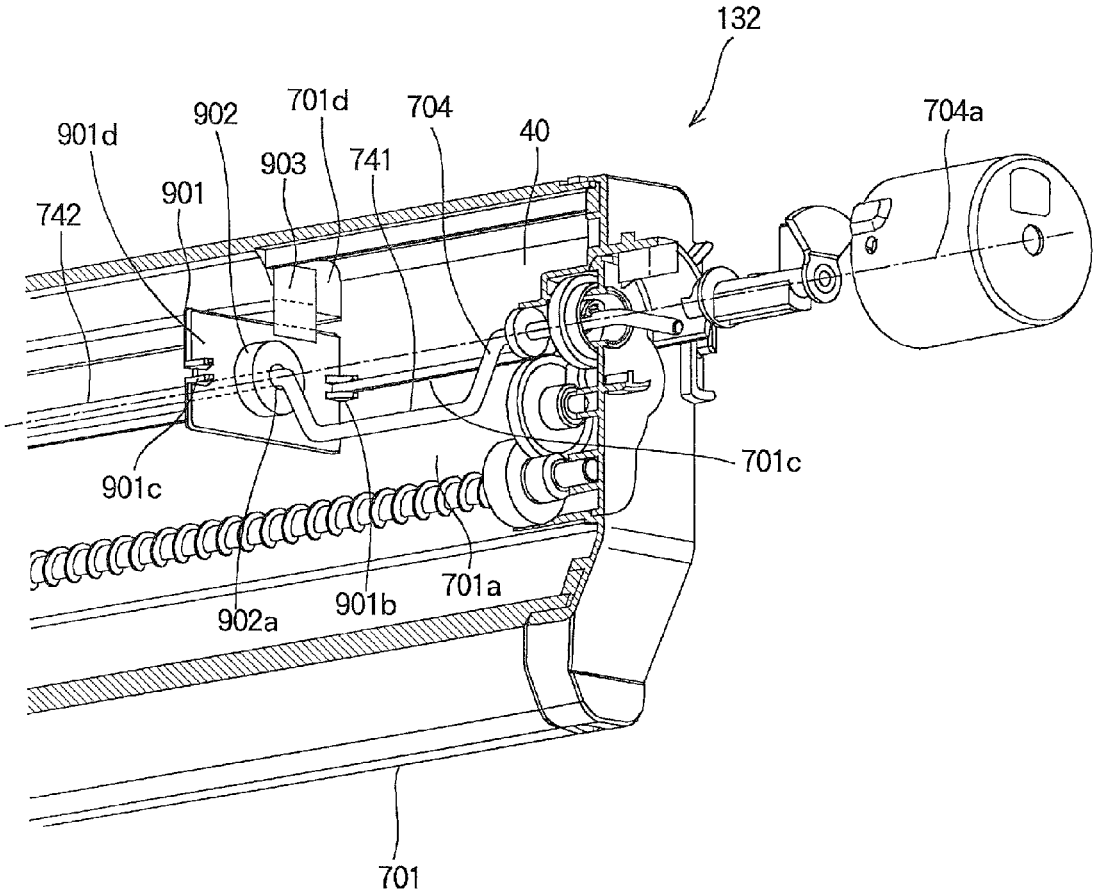
FIG. 22 is an enlarged view showing the vicinity of a driving portion of a waste toner full detection bar of a waste toner collecting container according to the third embodiment of the present invention.
Figure 23:
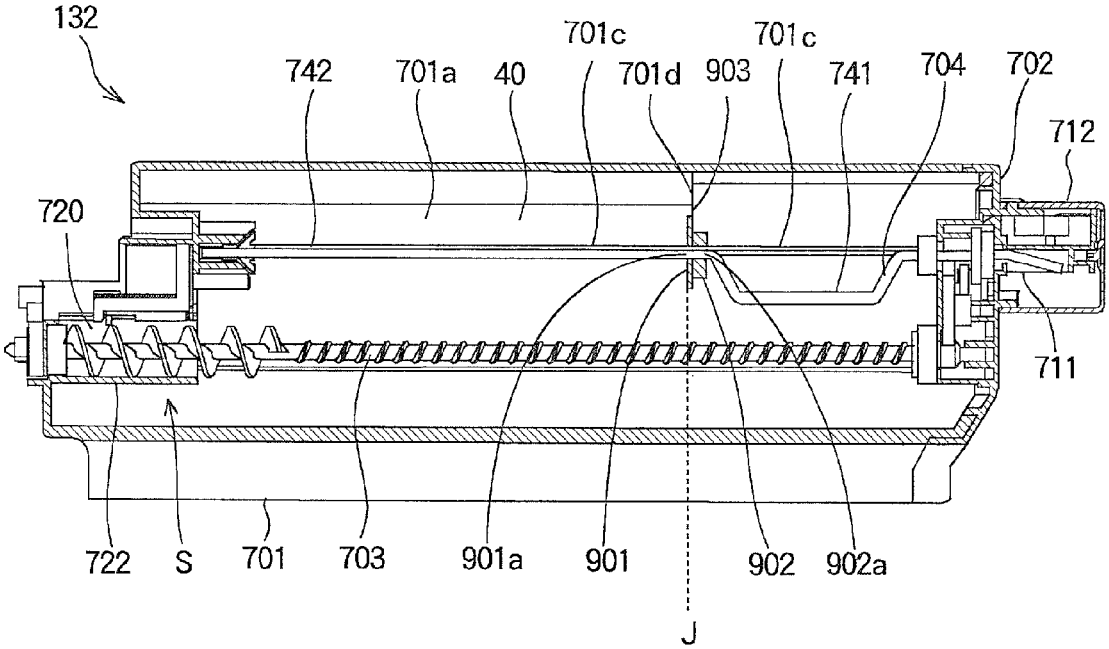
FIG. 23 is a sectional view showing an internal configuration of the waste toner collecting container according to the third embodiment.

Next, the third embodiment of the present invention will be described. FIG. 22 is an enlarged view showing the vicinity of a driving portion of a waste toner full detection bar 704 of a waste toner collecting container 132 according to the third embodiment. FIG. 23 is a sectional view showing an internal configuration of the waste toner collecting container 132 according to the third embodiment. In these figures, components that are the same as those of the first embodiment are assigned the same reference numerals.

As shown in FIGS. 22 and 23, the waste toner collecting container 132 according to the third embodiment includes a waste toner full detection wall 901 as a movable body or a movable member. The waste toner full detection wall 901 is located on the straight portion 742 of the waste toner full detection bar 704. The waste toner full detection wall 901 is provided so that the straight portion 742 of the waste toner full detection bar 704 penetrates the waste toner full detection wall 901. Further, the waste toner full detection wall 901 is located upstream of the crank portion 741 in the conveying direction of the waste toner.

A resilient member 902 is provided on a side surface 901*d* of the waste toner detection wall 901 on the crank portion 741 side. The resilient member 902 is formed of, for example, a sponge. A movement regulating film 903 (i.e., a resilient film member of a movement regulating member) is provided between the waste toner full detection wall 901 and an upper inner surface (i.e., a ceiling) of the waste toner collecting container 132. The movement regulating film 903 is configured to regulate a movement of the waste toner full detection wall 901 toward the crank portion 741 along the straight portion 742 of the waste toner full detection bar 704.

The outer frame 701 of the waste toner collecting container 132 includes a first inner wall 701*a* and a second inner wall 701*b*. Of the first inner wall 701*a* and the second inner wall 701*b*, only the first inner wall 701*a* is shown in FIGS. 22 and 23. The first inner wall 701*a* and the second inner wall 701*b* face each other in a widthwise direction of the outer frame 701 (i.e., in a direction perpendicular to the longitudinal direction). A pair of guide ribs 701*c* are provided on the first inner wall 701*a* and the second inner wall 701*b*. The guide ribs 701*c* are located at approximately the same height as the rotation axis 704*a* of the waste toner full detection bar 704. The guide ribs 701*c* are parallel to the rotation axis 704*a*. The guide ribs 701*c* are configured to support the waste toner full detection wall 901 so that the waste toner full detection wall 901 is slidable (movable).

In FIG. 23, the guide ribs 701*c* have rib widths that become wider than guide grooves 901*b* and 901*c* (described later) at an area located upstream of a predetermined position J along the waste toner full detection bar 704 in the conveying direction of the waste toner. In other words, the guide ribs 701*c* are configured to prevent the waste toner full detection wall 901 from moving upstream in the conveying direction of the waste toner beyond the position J.

The waste toner full detection wall 901 is formed of a resin. Further, the waste toner full detection wall 901 has an approximately square shape and has a thickness of approximately 1 mm. A through-hole 901*a* is formed on a center portion of the waste toner full detection wall 901. An inner diameter of the through-hole 901*a* is so set that the straight portion 742 of the waste toner full detection bar 704 penetrates the through-hole 901*a* without contacting an inner periphery of the through-hole 901*a*.

As shown in FIG. 22, the waste toner full detection wall 901 has a pair of guide grooves 901*b* and 901*c* that slidably engage the guide ribs 701*c*. The guide grooves 901*b* and 901*c* have groove widths which are slightly wider than the rib widths of the guide ribs 701*c*. Due to slidable engagement between the guide grooves 901*b* and 901*c* and the guide ribs 701*c*, the waste toner full detection wall 901 moves (slides) along the guide ribs 701*c*.

The resilient member 902 (for example, a sponge) has a through-hole 902*a* having substantially the same inner diameter as the through-hole 901*a* of the waste toner full detection wall 901. The resilient member 902 is bonded to the side surface 901*d* of the waste toner full detection wall 901 facing the crank portion 741. The through-hole 902*a* of the resilient member 902 is coaxial with the through-hole 901*a* of the waste toner full detection wall 901.

A top end portion of the movement regulation film 903 is fixed to the inner wall 701*d* of the outer frame 701. A lower end portion (i.e., a free end portion) of the movement regulating film 903 reaches to an upper end portion of the waste toner full detection wall 901 by a certain amount. With such a configuration, the movement regulating film 903 resiliently acts on the waste toner full detection wall 901 to prevent the waste toner full detection wall 901 from moving downstream (i.e., toward the crank portion 741) beyond the position J (FIG. 23) in the conveying direction of the waste toner.

In this regard, in an upper region of the waste toner storage portion 40 above the waste toner full detection wall 901, an area located upstream of the waste toner full detection wall 901 and an area located downstream of the waste toner full detection wall 901 are connected with each other. Further, in a region of the waste toner storage portion 40 below the waste toner full detection wall 901, an area located upstream of the waste toner full detection wall 901 and an area located downstream of the waste toner full detection wall 901 are connected with each other. In other words, connecting portions are formed above and below the waste toner full detection wall 901.

Other configurations of the waste toner collecting container 132 are the same as those of the waste toner collecting container 32 of the first embodiment.

Figure 24:
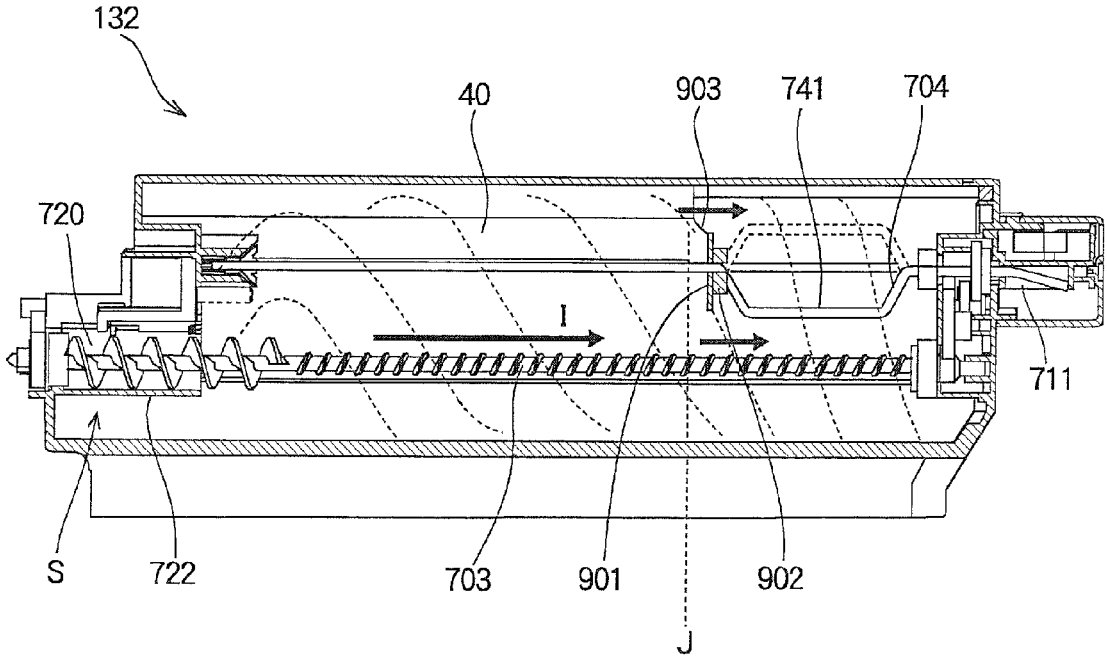
FIG. 24 is a sectional view showing a manner in which the waste toner is conveyed and accumulated in the waste toner collecting container according to the third embodiment.

Next, an operation of the waste toner collecting container 132 of the third embodiment will be described. FIG. 24 is a sectional view showing a manner in which the waste toner is conveyed and accumulated in the waste toner collecting container 132 according to the third embodiment.

As described in the first embodiment, the waste toner is conveyed by the waste toner conveying spiral 703 in the direction shown by the arrow I, and is accumulated. When the accumulated waste toner reaches the above described position J, the waste toner full detection wall 901 is biased by the waste toner, and moves toward the crank portion 741 causing the movement regulation film 903 to be deflected.

Then, when the resilient member 902 contacts the crank portion 741 and starts to be pressed by the crank portion 741, the crank portion 741 is subjected to frictional resistance from the resilient member 902. This causes a change in a rotational state of the waste toner full detection bar 704 when rotating by gravity due to the weight of the crank portion 741.

Since the waste toner full detection bar 704 rotates at the constant speed by the rotational force transmitted from the driving gear 714, the output signal of the detection sensor 760 has a similar waveform as when the waste toner reaches the disposition area of the crank portion 741 in the first embodiment (FIG. 16B). Therefore, it becomes possible to detect that the waste toner (having being conveyed in the direction shown by the arrow I in the waste toner storage portion 40) to reach the crank portion 741. In other words, the waste toner full state of the waste toner storage portion 40 can be detected.

Thereafter, the waste toner is further conveyed downstream (i.e., toward the crank portion 741) via the connecting portions above and below the waste toner full detection wall 901. The waste toner is accumulated in a remaining part of the waste toner storage portion 40 until the waste toner collecting container 132 is replaced by a user.

As described above, according to the third embodiment of the present invention, the crank portion 741 is pressed by the waste toner full detection wall 901 and the resilient member 902. This generates frictional resistance (i.e., a braking effect), and causes the change in the rotational state of the waste toner full detection bar 704 when rotating by gravity due to the weight of the crank portion 741. The waste toner full state of the waste toner storage portion 40 can be detected based on the change in the rotational state of the waste toner full detection bar 704. That is, the waste toner full state can be detected without being influenced by variation in accumulation state of the waste toner or variation in rotational resistance due to fluidity of the waste toner. As a result, detection accuracy of the waste toner full state can be enhanced.

Particularly, with a configuration in which the resilient member 902 (for example, the sponge) presses the crank portion 741, an increase in load on the waste toner full detection bar 704 can be reduced. Further, since the waste toner full detection wall 902 is slidably provided, it becomes possible to cause the change in the rotational state of the crank portion 741 (the waste toner full detection bar 704) according to the accumulation state of the waste toner.

Fourth Embodiment

Figure 25:
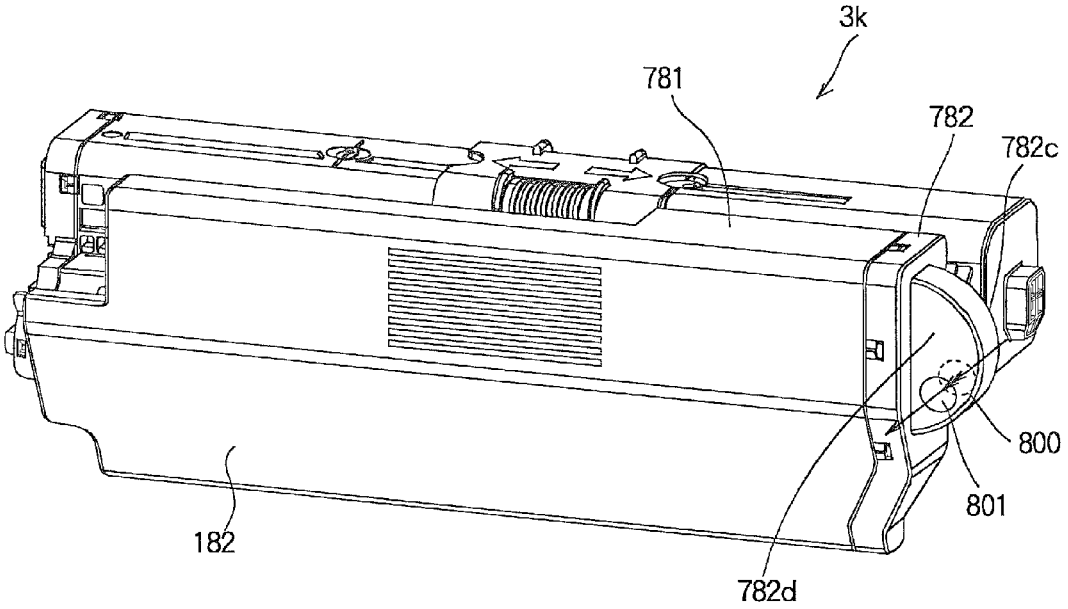
FIG. 25 is a perspective view showing a waste toner collecting container and a toner cartridge according to the fourth embodiment of the present invention.
Figure 26:
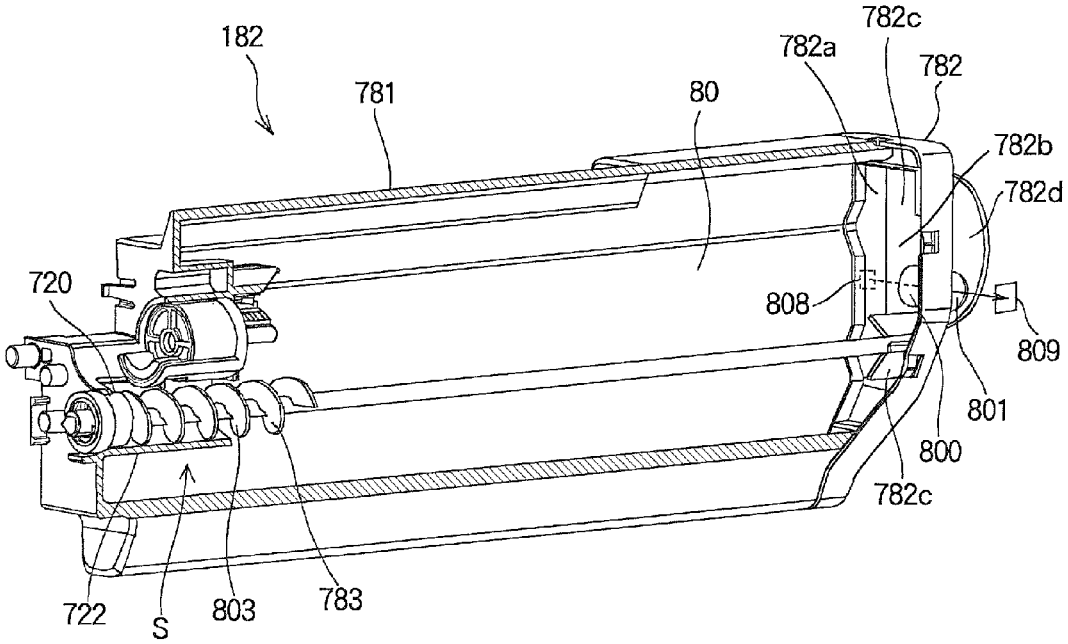
FIG. 26 is a partially cut-away perspective view showing the waste toner collecting container according to the fourth embodiment.

Next, the fourth embodiment of the present invention will be described. FIG. 25 is a perspective view showing a waste toner collecting container 182 and a toner cartridge 3*k* according to the fourth embodiment. FIG. 26 is a partially cut-away perspective view showing the waste toner collecting container 182 according to the fourth embodiment. In these figures, components that are the same as those of the first embodiment are assigned the same reference numerals.

In the fourth embodiment, the waste toner full state is detected without using the waste toner full detection bar 704 described in the first through third embodiments.

As shown in FIG. 25, the waste toner collecting container 182 of the fourth embodiment is mounted to the black toner cartridge 3*k*. As shown in FIGS. 25 and 26, the waste toner collecting container 182 has an outer frame 781 and a side plate 782 that form a waste toner storage portion 80 in which the waste toner is stored.

As described in the first embodiment, the waste toner receiving opening 720 is formed on an end portion of the outer frame 781 in the longitudinal direction. The waste toner receiving opening 720 receives the waste toner having been conveyed by the second conveying mechanism 28 (FIG. 1). A waste toner conveying spiral 783 is provided in the waste toner collecting container 182. The waste toner conveying spiral 783 (i.e., a developer conveying unit) is configured to convey the waste toner collected via the waste toner receiving opening 720 toward an opposite end of the waste toner conveying spiral 783.

An end of the waste toner conveying spiral 783 is rotatably supported by a shaft receiving portion 782*e* provided on a wall portion 782*a* of the side plate 782. In the fourth embodiment, the waste toner full detection bar 704 is not provided. For this reason, gears for transmitting the rotation of the waste toner conveying spiral 783 to the waste toner full detection bar 704 is not provided. Further, the waste toner full detection member 711 is not provided. In other respects, the waste toner conveying spiral 783 is configured in a similar manner to the waste toner conveying spiral 703 (FIG. 5) of the first embodiment or the waste toner conveying spiral 805 (FIG. 17) of the second embodiment.

The side plate 782 of the waste toner collecting container 182 has the wall portion 782*a* on the conveyance termination side of the waste toner storage portion 80. A protruding portion 782*b* is formed on the wall portion 782, and protrudes outward the waste toner collecting container 182. The protruding portion 782*b* includes a pair of wall portions 782*c* and 782*d* on both sides of the waste toner collecting container 182 in the widthwise direction. Light transmissive windows 800 and 801 (i.e., detection windows) are provided on the wall portions 782*c* and 782*d* so that the light transmissive windows 800 and 801 face each other. The light transmissive windows 800 and 801 are made of transparent plates. A light emitting portion 808 and a light receiving portion 809 (FIG. 26) are disposed inside the printer 1 so that the light emitting portion 808 and the light receiving portion 809 respectively face the light transmissive windows 800 and 801. The light emitting portion 808 and the light receiving portion 809 constitute a light-transmissive sensor.

Figure 27:
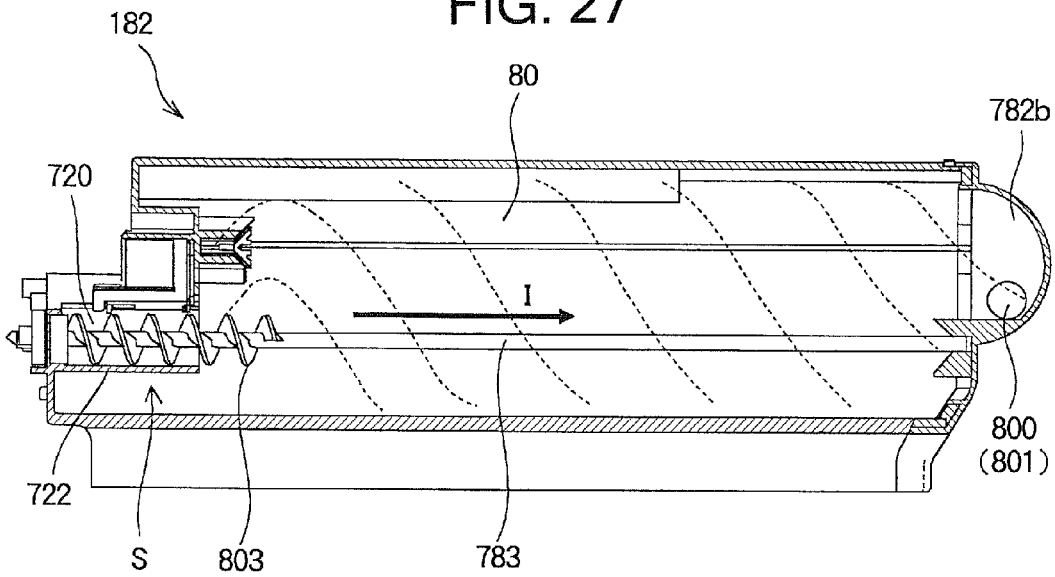
FIG. 27 is a sectional view showing a manner in which the waste toner is conveyed and accumulated in the waste toner collecting container according to the fourth embodiment.

FIG. 27 is a sectional view showing a manner in which the waste toner is conveyed and accumulated in the waste toner collecting container 182 according to the fourth embodiment. The waste toner is conveyed in the direction shown by the arrow I by the waste toner conveying spiral 783, and is accumulated in the waste toner storage portion 80 as described in the first embodiment.

In the fourth embodiment, when the accumulated waste toner reaches the side plate 782 of the waste toner storage container 182, an area between the light transmissive windows 800 and 801 is filled with the waste toner. Therefore, the waste toner blocks a light path between the light emitting portion 808 and the light receiving portion 809 of the light-transmissive sensor (FIG. 26), with the result that an amount of light received by the light receiving portion 809 decreases. Therefore, it becomes possible to detect that the accumulated waste toner reaches the side plate 782 of the waste toner collecting container 182 by monitoring the amount of light received by the light receiving portion 809.

As described above, according to the fourth embodiment of the present invention, the accumulation state of the waste toner can be detected based on a change in light transmissive state. Therefore, it is unnecessary to provide the waste toner full detection bar 704 described in the first through third embodiments. Accordingly, components required for detecting the waste tone can be reduced, and a manufacturing cost can be reduced.

Figure 28:
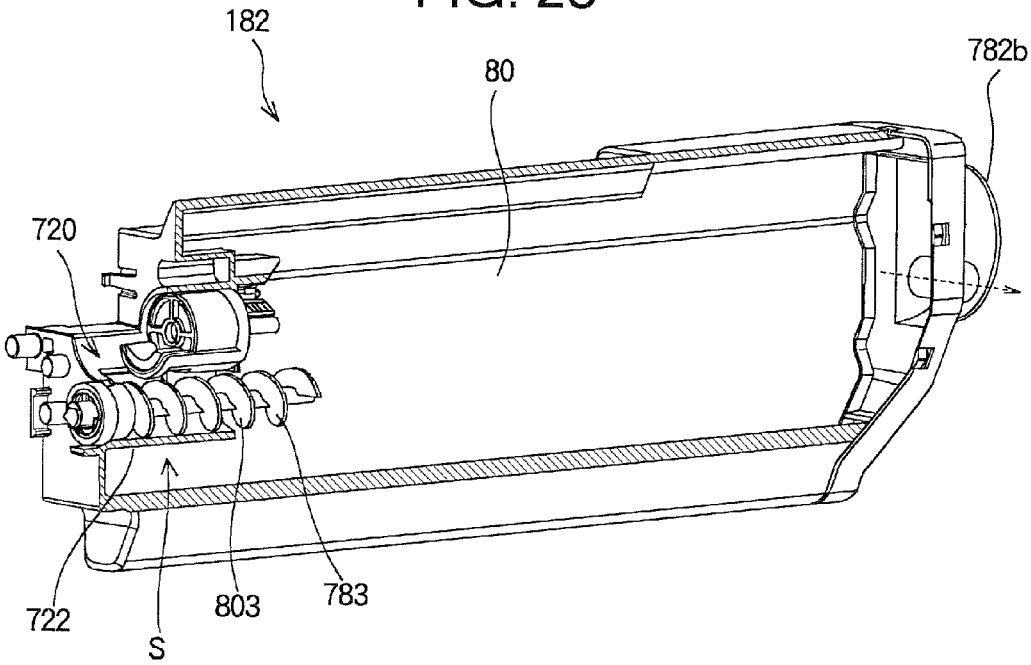
FIG. 28 is a partially cut-away perspective view showing the waste toner collecting container according to a modification of the fourth embodiment.

Next, a modification of the fourth embodiment will be described. FIG. 28 is a partially cut-away view showing the waste toner collecting container 182 according to a modification of the fourth embodiment. The waste toner conveying spiral 783 of the modification has the first spiral portion 803, but does not have a portion downstream of the first spiral portion 803 in the conveying direction of the waste toner. Even with such a configuration, the waste toner conveying spiral 783 has function to convey the waste toner downstream (i.e., toward the side plate 782), and therefore the same advantages as the fourth embodiment can be obtained.

In the above described embodiments, the waste toner collecting containers storing the waste toner have been described. However, the present invention is also applicable to a developer storage body storing a developer (for example, a fresh toner) other than the waste toner.

Further, although the electrophotographic printer has been described as an example of the image forming apparatus, the present invention is also applicable to, for example, a copier, a facsimile machine, a multifunction peripheral or the like.

While the preferred embodiments of the present invention have been illustrated in detail, it should be apparent that modifications and improvements may be made to the invention without departing from the spirit and scope of the invention as described in the following claims.

What is claimed is:

1. A developer storage body comprising:

a developer storage portion configured to store a developer and having a first end portion and a second end portion opposite to each other;

a developer receiving portion provided in the developer storage portion and located closer to the first end portion than to the second end portion, the developer receiving portion receiving the developer;

a developer conveying unit provided below the developer receiving portion and extending from the first end portion to the second end portion, the developer conveying unit conveying the developer from the first end portion toward the second end portion;

a developer detection unit including a detecting bar rotatably provided in the developer storage portion and provided above the developer conveying unit, the detection bar having a crank portion at a portion closer to the second end portion than to the first end portion, wherein the developer conveying unit includes a first developer pushing portion extending from a vicinity of the first end portion and a second developer pushing portion reaching a vicinity of the second end portion, the first developer pushing portion generating a larger conveying force than the second developer pushing portion, wherein the crank portion is located at a portion above the second developer pushing portion, wherein the detection bar has a first rotating operation caused by gravity due to a weight of the crank portion, and a second rotating operation caused by a power transmitted from the developer conveying unit, and wherein the developer detection unit detects an amount of the developer in the developer Storage portion based on a rotating operation of the detection bar.

2. The developer storage body according to claim 1, further comprising a conveying path provided below the developer receiving portion, the conveying path having a substantially cylindrical shape and being configured to guide the developer pushed by the first developer pushing portion.

3. The developer storage body according to claim 1, wherein the developer storage portion comprises:

a pushing area where the developer is pushed by the first developer pushing portion;

a detection area where the developer is detected by the developer detection unit, and an accumulation area in which the developer is accumulated, the accumulation area being located between the pushing area and the detection area.

4. The developer storage body according to claim 3, wherein the detection area has a length which is shorter than or equal to a half of a length of the accumulation area.

5. The developer storage body according to claim 3, wherein the first developer pushing portion is disposed in the pushing area, and the second developer pushing portion is disposed in the accumulation area and the detection area.

6. The developer storage body according to claim 1, wherein the first developer pushing portion includes a first rotation shaft with a first spiral blade protruding from the first rotation shaft by a first protruding amount, and wherein the second developer pushing portion includes a second rotation shaft with or without a second spiral blade protruding from the second rotation shaft by a second protruding amount, the second protruding amount being less than the first protruding amount.

7. The developer storage body according to claim 1, wherein the developer detection unit further comprises:

a movable body which is moved by being pushed by the developer accumulated in the developer storage portion; and a resilient member provided on the movable body;

wherein the change in the rotating operation of the detection bar is caused by contact between the resilient member and the detection bar is in a state where the developer is accumulated in the developer storage portion.

8. An image forming apparatus comprising the developer storage body according to claim 1.

9. The image forming apparatus according to claim 8, further comprising:

a process unit configured to form an image using the developer;

a first conveying unit configured to collect the developer from the process unit; and a second conveying unit configured to convey the developer collected by the first conveying unit to the developer storage body.

10. The image forming apparatus according to claim 8, wherein a plurality of process units each of which is configured to form an image using the developer, the plurality of process units being integrally held by a frame;

a plurality of first conveying units provided on the frame, each of the plurality of first conveying units being configured to collect the developer from the plurality of process units; and a second conveying unit provided on the frame and configured to convey the developer collected by the plurality of first conveying units to the developer storage body.

11. The developer storage body according to claim 1, wherein the developer storage portion comprises:

a pushing area where the developer is pushed by the first developer pushing portion;

a detection area where the developer is detected by the developer detection unit; and an accumulation area in which the developer is accumulated, the accumulation area being located between the pushing area and the detection area, wherein the detection area has a length which is shorter than or equal to a half of a length of the accumulation area, and wherein the first developer pushing portion is disposed in the pushing area, and the second developer pushing portion is disposed in the accumulation area and the detection area.

12. A developer collecting apparatus comprising:

a developer storage portion configured to store a developer and having a first end portion and a second end portion opposite to each other;

a developer receiving portion provided in the developer storage portion and located closer to the first end portion than to the second end portion, the developer receiving portion receiving the developer, a developer conveying unit provided below the developer receiving portion and extending from the first end portion to the second end portion, the developer conveying unit conveying the developer from the first end portion toward the second end portion; and a developer detection unit including a detecting bar rotatably provided in the developer storage portion and provided above the developer conveying unit, the detection bar having a crank portion at a portion closer to the second end portion than to the first end portion, wherein the developer conveying unit includes a first developer pushing portion extending from a vicinity of the first end portion and a second developer pushing portion reaching a vicinity of the second end portion the first developer pushing portion penetrating a larger conveying force than the second developer pushing portion, wherein the crank portion is located at a portion above the second developer pushing portion, wherein the detection bar has a first rotating operation caused by gravity due to a weight of the crank portion, and a second rotating operation caused by a power transmitted from the developer conveying unit, and wherein the developer detection unit detects an amount of the developer in the developer storage portion based on a rotating operation of the detection bar.

* * * * *